US008002264B2

(12) United States Patent
Matsushima

(10) Patent No.: US 8,002,264 B2
(45) Date of Patent: Aug. 23, 2011

(54) AUTOMATIC DOCUMENT FEEDER

(75) Inventor: Ryoichi Matsushima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 305 days.

(21) Appl. No.: 11/515,885

(22) Filed: Sep. 6, 2006

(65) Prior Publication Data

US 2007/0052149 A1 Mar. 8, 2007

(30) Foreign Application Priority Data

Sep. 6, 2005 (JP) ..... 2005-258256

(51) Int. Cl.
*B65H 29/66* (2006.01)

(52) U.S. Cl. ..... 271/65; 271/186

(58) Field of Classification Search ..... 271/264, 271/65, 291, 303, 186; 399/364
See application file for complete search history.

(56) References Cited

U.S. PATENT DOCUMENTS

| | | | | |
|---|---|---|---|---|
| 5,292,113 | A | 3/1994 | Morigami et al. | |
| 5,689,793 | A | 11/1997 | Kobayashi et al. | |
| 5,819,152 | A | 10/1998 | Kobayashi et al. | |
| 5,826,155 | A | 10/1998 | Kobayashi et al. | |
| 5,903,811 | A | 5/1999 | Kobayashi et al. | |
| 6,161,831 | A * | 12/2000 | Kusakabe et al. | 271/186 |
| 6,215,976 | B1 * | 4/2001 | Shida et al. | 399/367 |
| 2006/0285902 | A1 * | 12/2006 | Horaguchi | 399/374 |

FOREIGN PATENT DOCUMENTS

| | | |
|---|---|---|
| JP | 05-088482 | 4/1993 |
| JP | 08-133551 | 5/1996 |
| JP | 813351 | 5/1996 |
| JP | 10-194482 | 7/1998 |
| JP | 2000-264495 | 9/2000 |
| JP | 2000264521 A * | 9/2000 |
| JP | 2001-117292 | 4/2001 |
| JP | 2001117292 | 4/2001 |
| JP | 2002-274689 | 9/2002 |
| JP | 2003-072977 | 3/2003 |

OTHER PUBLICATIONS

Office Action received for Japanese Application No. 2005-258256 mailed Jul. 8, 2008.

* cited by examiner

*Primary Examiner* — Michael C McCullough
(74) *Attorney, Agent, or Firm* — Banner & Witcoff, Ltd.

(57) ABSTRACT

An automatic document feeder (ADF), which is capable of feeding a document for double-sided reading, includes an input tray, an output tray, which are vertically arranged, a U-shaped document feed path, which is made up of an upper portion, a curved portion, and a lower portion, feeding rollers disposed in the document feed path, a bidirectional feed path connected to a connection position, a bidirectional feed roller provided in the bidirectional feed path, a bypass connecting a branch position and the connection position, and an ADF cover, which is rotatable with respect to an ADF frame. A paper jam is readily cleared with a simple structure and reasonable cost.

12 Claims, 16 Drawing Sheets

AUTOMATIC DOCUMENT FEEDER

CROSS REFERENCE TO RELATED APPLICATIONS

This application claims priority from the Japanese Patent Application No. 2005-258256 filed on Sep. 6, 2005, the entire subject matter of which is incorporated herein by reference.

FIELD OF THE INVENTION

Illustrative aspects of the invention relate to automatic document feeders suited for the double-sided reading of documents.

BACKGROUND

Image reading apparatuses included in copiers, scanners, and multifunction apparatus having a copy function and a scanning function, contain automatic document feeders ("ADF") to feed documents from an input tray through a feed path to an output tray. In addition, in order to read a document printed on a first surface and a second surface, known document feeders that feed a document for double-sided reading by reversing the document's leading end and trailing end.

FIG. 16 shows a feed path in a conventional document feeder capable of double-sided reading. As shown in the figure, a document P is placed on an input tray 90 with a first surface (a first page) facing upward. This document P is fed to a feed path 92 by a pickup roller 91. In the feed path 92, the document P is fed by feed rollers 93 provided as appropriate, and the first surface of the document P is read by an image reading device, such as CCD or CIS, when the document P passes a reading position X. When a sensor detects a trailing end of the document P, of which the first surface has been read, ejection rollers 94 are stopped with the trailing end of the document P nipped. As the ejection rollers 94 are rotated backward, the document P is fed to a switchback path 95. The document P goes from the switchback path 95 toward an upstream side of the reading position X of the feed path 92. As a result, the leading end and the trailing end of the document P are reversed, and the document P is inverted.

Then, the document P is fed by the feed rollers 93, and the second surface of the document P is read by the image reading device when the document P passes the reading position X. When a sensor detects the trailing end of the document P, of which the second surface now has been read, the ejection rollers 94 are stopped again with the trailing end of the document P nipped, and then the document P is fed back to the switchback path 95. When the document P enters the feed path 92 again from the switchback path 95, its leading end and trailing end are reversed again, that is, the first surface faces the reading position X, and the document P is again inverted. The document P then is fed on the feed path 92 and ejected to an output tray 96 with its first surface facing downward. Thus, the first and second surfaces of the document P are read, and the document P is ejected to the output tray 96 in the same sequence as the original documents P, in the original order, placed on the input tray 90.

In the above automatic document feeder, the feed path 92 is designed to be opened to remove a jammed document P. For example, by opening an upper cover of the housing of the automatic document feeder in which the feed path 92 is formed, an outer guide surface, which defines an upper portion of the feed path 92, is also opened, so that the upper portion of the feed path 92 is released. Thus, a document jam in the upper portion of the feed path 92 can be cleared.

During double-sided reading of a document P fed by the existing automatic document feeder, a document jam may occur in the switchback path 95. To clear the document jam in the switchback path 95, a structural member forming an inner guide surface, which deforms the upper portion of the feed path 92, and the upper guide surface of the switchback path 95 is designed to rotate. By opening the upper cover of the apparatus housing and then rotating the member, the switchback path 95 is released. Thus, a document jam in the switchback path 95 can be cleared.

In conventional automatic document feeders, such as described above, clearing jams in feed path 92 is a different operation than clearing jams in switchback path 95, and a user needs to open the upper cover, and rotate a different member according to where the paper jam occurred. However, when a document P is jammed, the user typically does not know where the paper jam has occurred. Thus, the user needs to open the upper cover and test the various rotatable members until the jammed document P is found.

Sensors for detecting the presence or absence of the document P may be disposed in the feed path 92 and the switchback path 95 to sense the position of the jammed document. The sensors may be connected to a display to inform the user. However, even with sensors, when a jam occurs in the switchback path 95, it is generally not enough to open the upper cover to clear the jam. As discussed above, members may need to be rotated thus requiring a mechanism to rotate the members.

SUMMARY

Aspects of the invention relate to a device having an automatic document feeder that feeds documents for double-sided reading, wherein the device is configured to clear paper jams readily with a simple structure and reasonable cost.

BRIEF DESCRIPTION OF THE DRAWINGS

Aspects of the invention will be described in detail with reference to various example structures and the following figures, wherein.

DETAILED DESCRIPTION

Illustrative aspects of the present invention will be described with suitable reference to the accompanying drawings. These aspects merely provide examples of the invention, and it is needless to say that the aspects can be suitably modified without departing from the gist of the invention.

Figure 1:
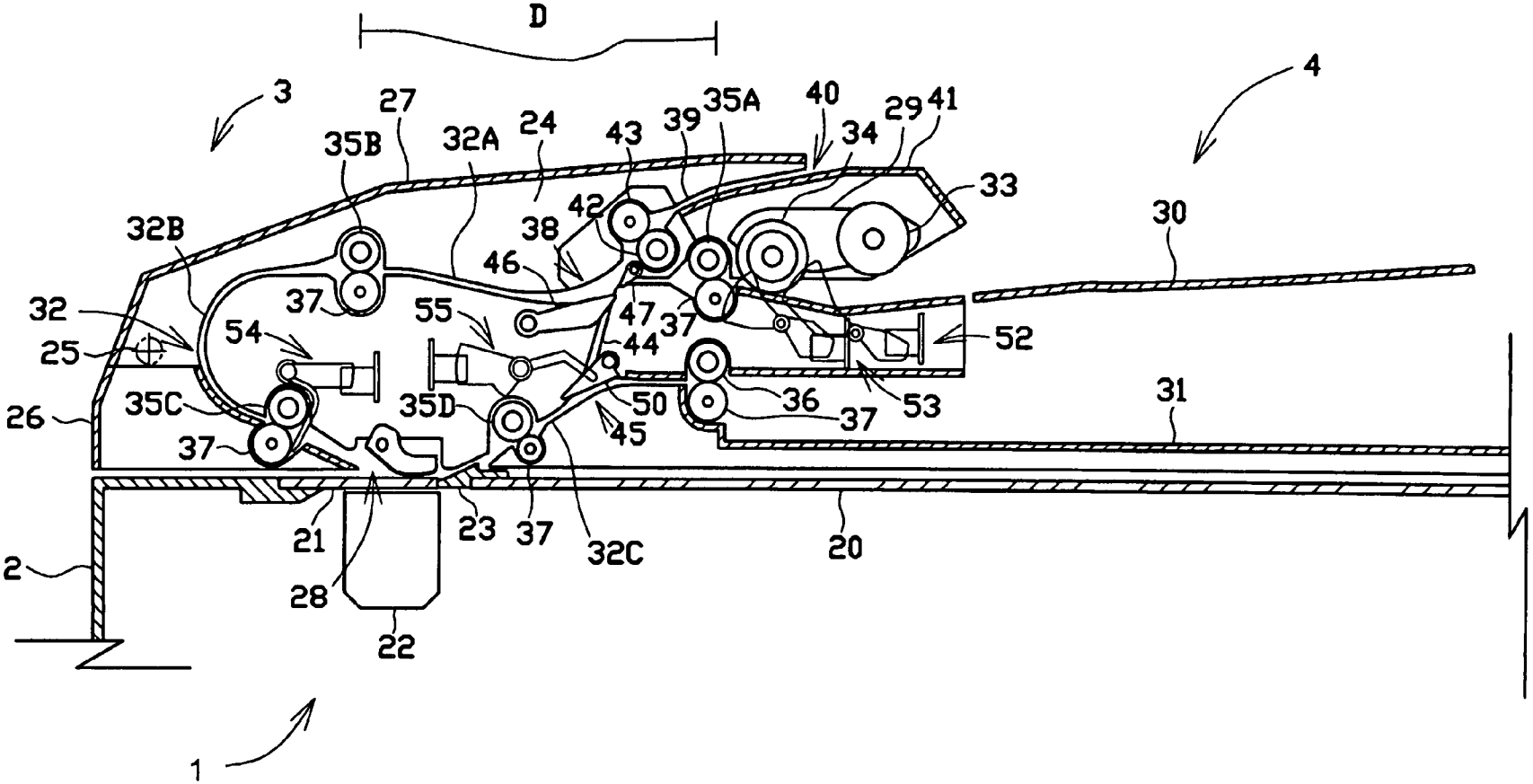
FIG. 1 is a side sectional view of an internal structure of an image reading apparatus 1 according to an illustrative embodiment of the invention.

FIG. 1 shows major internal structures of an image reading apparatus 1. The image reading apparatus 1 may be an image reader for reading documents, for example, for a copier, a facsimile, a scanner, a multi-function device (MFD), and the like.

As shown in FIG. 1, the image reading apparatus 1 is provided with a document mounting table 2 that functions as a flatbed scanner (FBS), and a document cover 4 including an automatic document feeder 3 (ADF). The document cover 4 is attached to the document mounting table 2, and it may be opened and closed via hinges at the rear.

Platen glasses 20, 21 are disposed on the top of the document mounting table 2 where the document cover 4 faces. When the document cover 4 is opened, the platen glasses 20, 21 are exposed as the top surface of the document mounting table 2. When the document cover 4 is closed, the top surface of the document mounting table 2 including the platen glasses 20, 21 is completely covered. An image reading unit 22 is built into or otherwise associated with the document mounting table 2 so as to face the platen glasses 20, 21.

When the image reading apparatus 1 is used as an FBS, a document is placed on the platen glass 20. The platen glass 20 is formed of, for example, a transparent glass plate. An opening is formed in a center on the top of the document mounting table 2, and the platen glass 20 is exposed through the opening. An area where the platen glass 20 is exposed from the opening is a scan area in the FBS.

The platen glass 21 is at a reading position when the ADF 3 of the image reading apparatus 1 is used. The platen glass 21 is formed of, for example, a transparent glass plate. At the reading position of the document mounting table 2, an opening 28 is formed, from which the platen glass 21 is exposed. The platen glass 21 exposed from the opening 28 extends back or in a depth direction of the image reading apparatus 1 in response to a length of the image reading unit 22 in a main reading direction.

A positioning member 23 is interposed between the platen glasses 20 and 21. The positioning member 23 of this example is a long flat plate extending back or in the depth direction of the image reading apparatus 1, e.g., to the same extent as the platen glass 21. The positioning member 23 may be used as a reference point for a document to be placed on the platen glass 20 in the FBS. Thus, the positioning member 23 may have, on its top surface, markings that indicate a center position and both side positions of various different document sizes, such as letter size, A4, and B5. The positioning member 23 also may formed with a guide surface, at its top surface, that catches and deflects the leading edge of a document moving along the platen glass 21 to thereby return the document to the ADF 3.

The image reading unit 22 is an image sensor that emits light onto a document from a light source via the platen glasses 20 and 21, focuses the light reflected from the document into a photoreceptor and converts the reflected light into electric signals. As the image reading unit 22, contact image sensors (CIS), charge coupled device (CCD) image sensors, and/or other desired types of image sensors may be used. The image reading unit 22 is provided below the platen glasses 20, 21 so as to be reciprocally movable, e.g., by a belt drive mechanism or the like, which is a scanning mechanism. For example, a driving force from a carriage motor may be transmitted to the image reading unit 22, and the image reading unit 22 then may be reciprocally moved in parallel with the platen glasses 20, 21.

The document cover 4 is provided with the ADF 3 that successively feeds documents from an input tray 30 (document placing portion) to an output tray 31 (document ejection portion) via a document feed path 32. The document feed path 32 functions as an input transfer path and an output transfer path. During the feeding process by the ADF 3, while a document passes over the reading position on the platen glass 21, the image reading unit 22 provided under the platen glass 22 scans images on the document.

As shown in FIG. 1, the document cover 4 is provided with the input tray 30 and the output tray 31, which are vertically arranged in this example structure so that the input tray 30 is placed over the output tray 31. A document being read by the ADF 3 is placed on the input tray 30. If desired, a stack of documents to be read may be placed on the input tray 30 with their first sides facing upward and their leading edges inserted into the document feed path 32.

The output tray 31 in this example structure is disposed under the input tray 30 vertically away therefrom, and the output tray 31 is integrally formed with the top surface of the document cover 4. A document that has undergone a reading process is ejected from the ADF 3 and maintained separate from a stack of documents (if any) on the input tray 30 and is held on the output tray 31 with its first surface facing down.

As shown in FIG. 1, the document feed path 32, which has substantially a horizontal "U" shape in vertical sectional view, is formed inside the ADF 3 so as to connect the input tray 30 and the output tray 31 via the reading position on the platen glass 21. The document feed path 32 is continuously formed of various structural members forming an ADF frame 26, guide plates, and guide ribs, and the feed path 32 has a width where a document can pass. The input tray 30 and the output tray 31 are vertically arranged and the document feed path 32 is formed to connect the trays in substantially a horizontal "U" shape in vertical sectional view. With this structure, the ADF 3 is decreased in width and consequently reduced in overall size compared to prior art feeders.

The document feed path 32 has the horizontal "U" shape, which extends from the input tray 30 to one end of the document cover 4 (to the left in FIG. 1), curves downward so as to reverse its feeding direction, reaches the reading point on the platen glass 21, and extends from the reading position to the output tray 31. The document feed path 32 is mainly made up of three portions: an upper portion 32A, a curved portion 32B, and a lower portion 32C. The upper portion 32A and the lower portion 32C are upper and lower straight portions in the "U" shape, and the curved portion 32B is curved to continuously connect the upper portion 32A and the lower portion 32C. The document feed path 32 is used for both single-side reading and double-sided reading of a document using the ADF 3.

The feed path 32 is formed with the opening 28 in the lower portion 32C at a position facing the platen glass 21, which is in a reading position. A document passes the platen glass 21 via the opening 28 when it is fed in the lower portion 32C of the document feed path 32. The opening 28 is formed on the lower surface of the document cover 4. When the document cover 4 is opened with respect to the document mounting table 2, the opening 28 is exposed toward the front of the apparatus. If a paper jam occurs in the lower portion 32C of the document feed path 32 while the ADF 3 is used, it can be cleared by opening the document cover 4 and pulling out the jammed document, which is exposed via the opening 28.

The document feed path 32 includes transfer elements for feeding the document. As shown in FIG. 1, the transfer elements includes a pickup roller 33, a separation roller 34, feeding rollers 35A, 35B, 35C, 35D and pinch rollers 37, which are pressed into contact with the feeding rollers 35A, 35B, 35C, 35D.

As shown in FIG. 1, the pickup roller 33 and the separation roller 34 are disposed near a most upstream side of the document feed path 32. The pickup roller 33 is rotatably provided at an end portion of an arm 29, which is provided coaxially with a shaft of the separation roller 34. The separation roller 34 is rotatably provided away from the pickup roller 33 in the sheet feeding direction so as to contact an opposing surface of the document feed path 32. A driving force is transmitted from a motor to the pickup roller 33 and the separation roller 34, which are rotatably driven. The driving force from the motor is further transmitted to the arm 29, which is vertically moved. The pickup roller 33 and the separation roller 34 are identical in diameter size, and they are driven at the same peripheral velocity. A separation pad may be disposed at an opposite position of the separation roller 34 to press into contact with a roller surface of the separation roller 34 and separate documents by friction.

The feeding rollers 35A, 35B, 35C, 35D are disposed in different positions on the document feed path 32. In the illustrative embodiment, the feed roller 35A is disposed directly downstream from the separation roller 34, the feed roller 35B is disposed in the upper portion 32A of the document feed path 32, the feed roller 35C is disposed in the lower portion 32C of the document feed path 32 and directly upstream from the reading position, and the feed roller 35D is disposed in the lower portion 32C of the document feed path 32 and directly downstream from the reading position. The feeding rollers 35A, 35B, 35C, 35D are rotatably driven by power transmitted from the motor.

The pinch rollers 37 are provided to face their respective feeding rollers 35A, 35B, 35C, and 35D. Each pinch roller 37 is elastically urged (e.g., by a spring) and is pressed in contact with the roller surface of its respective feeding roller 35A, 35B, 35C, and 35D. When each feeding roller 35A, 35B, 35C, 35D is rotated, its respective pinch roller 37 is also rotated. In this manner, a document is pressed in contact with each feeding roller 35A, 35B, 35C, 35D, and a rotational force thereof is transmitted to convey or move the document.

A distance D of the document feed path 32 from the feeding roller 35A and the pinch roller 37 (a first roller pair) to the feeding roller 35B and the pinch roller 37 (a second roller pair) is longer than a length of the smallest-sized document of which the ADF 3 is capable of feeding. For example, if the smallest length of a document of which the ADF 3 is capable of feeding is a length of A5 size, the distance D is shorter than 210 mm. Thus, when an A5 sized document is supplied longitudinally, the document is pinched either between the feeding roller 35A and the pinch roller 37 or between the feeding roller 35B and the pinch roller 37. The document is fed in the document feed path 32 under rotation of one or both of the feeding rollers 35A and 35B. Intervals among the feeding rollers 35B, 35C, 35D, and an ejection roller 36 are shorter than 210 mm. The document to be fed in the document feed path 32 is pinched by either of the feeding rollers 35A, 35B, 35C, and 35D pressing in contact with the corresponding pinch rollers 37.

In this example, the distance D is longer than the length of a B6 sized document, 182 mm, which is smaller than A5 sized document. Thus, in the upper portion 32A of the document feed path 32, the B6 sized document is not pinched by any of the feeding roller 35A and the pinch roller 37, and the feeding roller 35B and the pinch roller 37. A document that is not pinched by any of these is not fed in the document feed path 32. In other words, a document that can be fed in the upper portion 32A of the document feed path 32 has a length longer than the distance D like an A5 sized document. Thus, a B6 sized document remains in the document feed path 32 without being pinched by any roller pair from the feeding roller 35A to the feeding roller 35B, even if it is fed into the document feed path 32 from the input tray 30. There is no need to lengthen each interval among the feeding rollers 35B, 35C, 35D and the ejection roller 36 longer than 182 mm. In the illustrative embodiment, although the smallest document size the ADF 3 can feed is A5 as an example, it will be obvious that other sizes such as B6 and A6 may be the smallest size capable of being fed by the ADF 3.

The ejection roller 36 is disposed near a most downstream side of the document feed path 32. As is the case with the feed rollers 35A, 35B, 35C, 35D, a driving force from the motor is transmitted to the ejection roller 36 and the ejection roller 36 is rotated. A pinch roller 37 is also disposed to face the ejection roller 36, and this pinch roller 37 is elastically urged by a spring and pressed in contact with the ejection roller 36.

A bidirectional feed path 39 (also called a "switchback" path) is connected to the upper portion 32A on the document feed path 32. The bidirectional feed path 39 functions as an intermediate transfer path. The bidirectional feed path 39 is used for double-sided reading, and it is designed to reverse the leading end and the trailing end of a document whose first surface has been scanned and to resend the document to the document feed path 32. The bidirectional feed path 39 is connected to a connection position 38 of the upper portion 32A, which is disposed on an upstream side of the reading position, and extends diagonally upward from the connection position 38 to the input tray 30. As the bidirectional feed path 39 is disposed diagonally upward from the connection position 38 to the input tray 30, space above the input tray 30 can be used effectively.

A termination 40 of the bidirectional feed path 39 is opened toward the top surface of the ADF 3. The length of the bidirectional feed path 39 is shorter than the length of the maximum sized document, at least where double-sided reading is desired. Thus, a document going into the bidirectional feed path 39 partially protrudes from the termination 40 outside the ADF 3. That is, the length of the bidirectional feed path 39 may not be longer than the length of the maximum sized document, at least where double-sided reading is desired.

A document supporting portion 41 is formed continuously from the termination 40 of the bidirectional feed path 39 to the input tray 30. The document supporting portion 41 is designed to support the document ejected from the termination 40 of the bidirectional feed path 39, and forms an ADF cover 27 above the pickup roller 33 and the separation roller 34. The ADF cover 27 functions as a second guide member.

Figure 2:
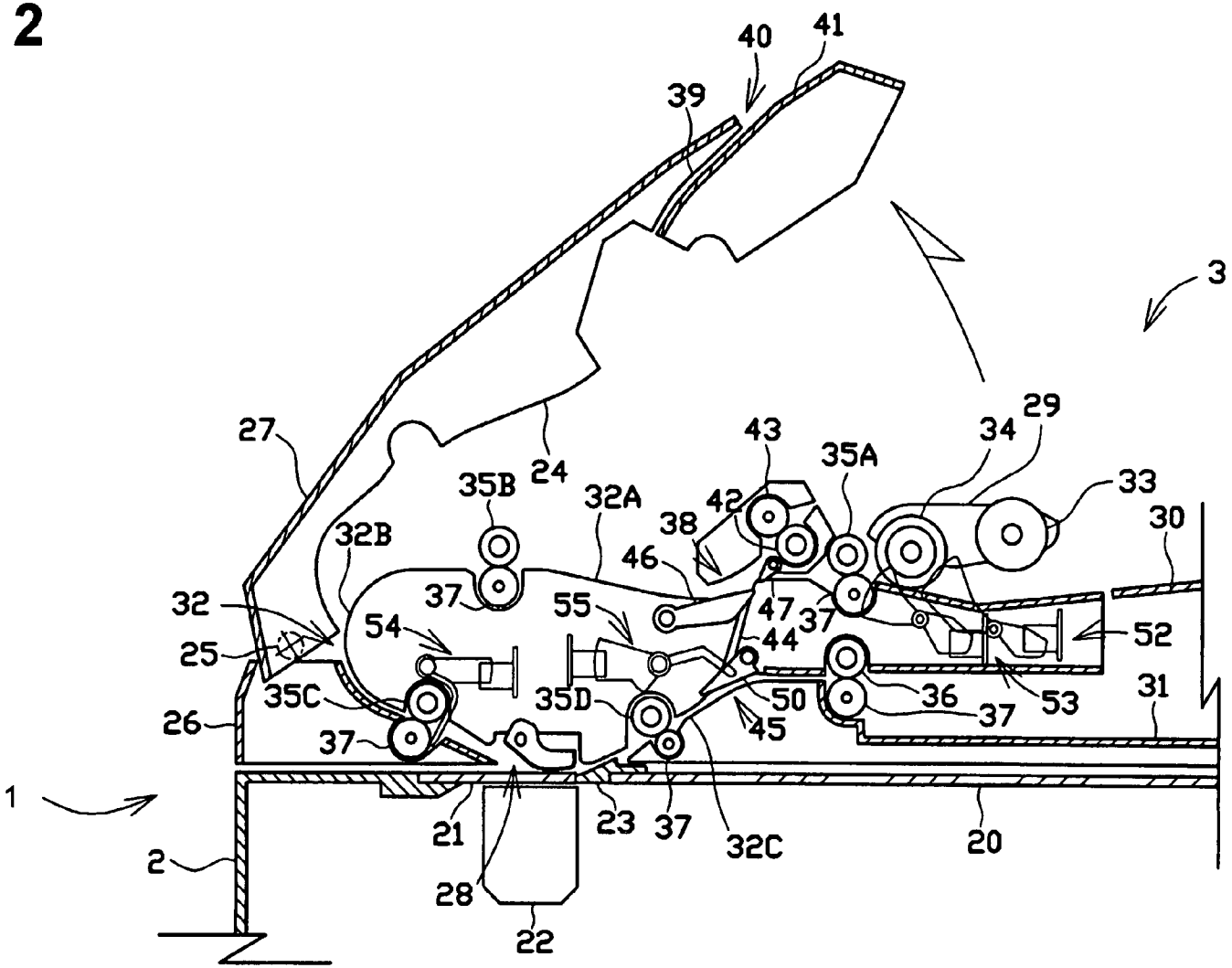
FIG. 2 is an enlarged view of the internal structure of the image reading apparatus of FIG. 1 when an ADF cover 27 is open according to at least one illustrative aspect of the invention.

The ADF cover 27 and the ADF frame 26, which is integrally formed with the document cover 4, constitute a housing of the ADF 3. The ADF cover 27 is provided to rotate with respect to the ADF frame 26, and forms the top surface of the housing of the ADF 3. Thus, the termination 40 of the bidirectional feed path 39 is opened in the ADF cover 27. As shown in FIG. 2, the ADF cover 27 is rotated on a rotating shaft 25 provided on a side of the document cover 4 (left side in FIG. 1) in such a manner to raise the input tray 30 side. The ADF frame 26 functions as a first guide member.

The ADF cover 27 is extended to cover the pickup roller 33 and the separation roller 34 at its free end. The document supporting portion 41, which is integrally formed with the ADF cover 27, is extended from the termination 40 over the pickup roller 33 and the separation roller 34 to the input tray 30. Thus, in double-sided reading, a document, which enters the bidirectional feed path 39 and projects outside of the ADF 3 from the termination 40 will not trail down to the downstream side (left side in FIG. 1) of the pickup position of the documents placed on the input tray 30, thereby preventing disarrangement of the documents at the pickup position.

Guide ribs 24 are provided to protrude on the inner surface of the ADF cover 27. The guide ribs 24 are spaced away from each other at specified intervals along a width of the document feed path 32, and form outside guide surfaces near the feed roller 35A, and outside guide surfaces from the downstream side of the connection position 38 to a part of the curved portion 32B. In addition, the guide ribs 24 are formed with a feed path on the termination 40 side of the bidirectional feed path 39. This feed path functions as a part of the intermediate transfer path.

The ADF cover 27 is rotated with respect to the ADF frame 26 to change its position between an open position shown in FIG. 1 and a closed position shown in FIG. 2. When the ADF 3 is used, the ADF cover 27 should be closed in the closed position. The ADF cover 27 is engaged with the ADF frame 26 to maintain the closed position. A known mechanism such as a lock lever may be used as an engagement mechanism of the ADF cover 27. When the engagement mechanism of the ADF cover 27 is released, the ADF cover 27 is rotated in the closed position, and the guide ribs 24 are also rotated with the ADF cover 27, the document feed path 32 from the connection position 38 of the upper portion 32A to a part of the curved portion 32B is released. As the feed roller 35B is disposed between the connection position 38 and the curved portion 32B in the document feed path 32, it is exposed when the ADF cover 27 is maintained in the open position. When the ADF cover 27 is rotated in the open position, the pickup roller 33 and the separation roller 34 are released at their upper sides. Thus, the feed roller 35A disposed directly downstream of the separation roller 34 is exposed.

A bidirectional feed roller 42 is disposed in the bidirectional feed path 39. As a driving force is transmitted from a motor to the bidirectional feed roller 42, the bidirectional feed roller 42 is rotated in both the forward and reverse directions. Facing the bidirectional feed roller 42, a pinch roller 43 is disposed. The pinch roller 43 is elastically urged, e.g., by a spring at its shaft, to be pressed in contact with a roller surface of the bidirectional feed roller 42, and is rotated following the rotation of the bidirectional feed roller 42. The document is pressed against the bidirectional feed roller 42 by the pinch roller 43, and rotation of the bidirectional feed roller 42 is transmitted to the document. The bidirectional feed roller 42 and the pinch roller 43 function as a bidirectional feeding member that feeds a document in two directions.

As shown in FIG. 2, a part of the bidirectional feed path 39 where the bidirectional feed roller 42 and the pinch roller 43 are disposed is fixed to the ADF frame 26, and thus remains in the ADF frame 26 without being rotated along with the ADF cover 27. As the pinch roller 43 is urged against the bidirectional feed roller 42, a member supporting a shaft of the pinch roller 43 requires supporting the pinch roller 43 at a specified position against the urging force. As shown in the figure, by supporting the pinch roller 43 with a member provided at the ADF frame 26, the ADF cover 27 does not need an engagement mechanism to maintain its closed position against the urging force of the pinch roller 43. Thus, the ADF cover 27 can be simply structured. On the other hand, the bidirectional feed path 39 from the position where the bidirectional feed roller 42 and the pinch roller 43 are disposed to the termination 40 is rotated along with the ADF cover 27.

A bypass 44 is formed on a downstream side of the reading position in the lower portion 32C of the document feed path 32. The bypass 44 is configured to guide a document whose first surface has been read at the reading position, to the bidirectional feed path 39 in double-sided reading. The bypass 44 diverges from a branch position 45, which is on the downstream side of the reading position in the lower portion 32C of the document feed path 32, and extends diagonally upward to connect with the connection position 38. The connection position 38, which connects the bidirectional feed path 39 to the U-shaped document feed path 32, is disposed in the upper portion 32A of the document feed path 32. The branch position 45, in which the bypass 44 is diverged from the document feed path 32, is disposed in the lower portion 32C of the document feed path 32. Thus, the structure in the vicinity of the curved portion 32B can be simplified.

The feed path from the reading position of the document feed path 32 via the bypass 44 to the bidirectional feed path 39 is formed in the shape of an S in a vertical sectional view. With this shape, documents can be fed smoothly from the reading position of the document feed path 32 via the bypass 44 to the bidirectional feed path 39, and a paper jam can be prevented at the connection position 38 and the branch position 45. The feed path from the upper portion 32A, which is a straight portion of the U-shaped document feed path 32, via the connection position 38 to the bidirectional feed path 39 is also formed in the shape of an S in a vertical sectional view. With this shape, documents can be fed smoothly from the upper portion 32A of the document feed path 32 via the connection position 38 to the bidirectional feed path 39, and a paper jam can be prevented at the connection position 38.

A feed path is formed in a loop starting from the connection position 38 of the document feed path 32 via the reading position and the branch position 45 and reaching the connection position 38 again through the bypass 44. The length of the feed path is set longer than a length of a maximum size document, which is ready for double-sided reading. For example, when the maximum size document is A4, its length is 297 mm. When the maximum size document is a letter size, its length is 11 inches. When the maximum size document is a legal size, its length is 14 inches. The length of the above feed path is set longer than these lengths. Thus, in double-sided reading, when the leading end of a document passes the reading position and then enters the connection position 38, the trailing end of the document surely passes the connection position 38. Thus, a paper jam can be prevented at the connection position 38.

Figure 3:
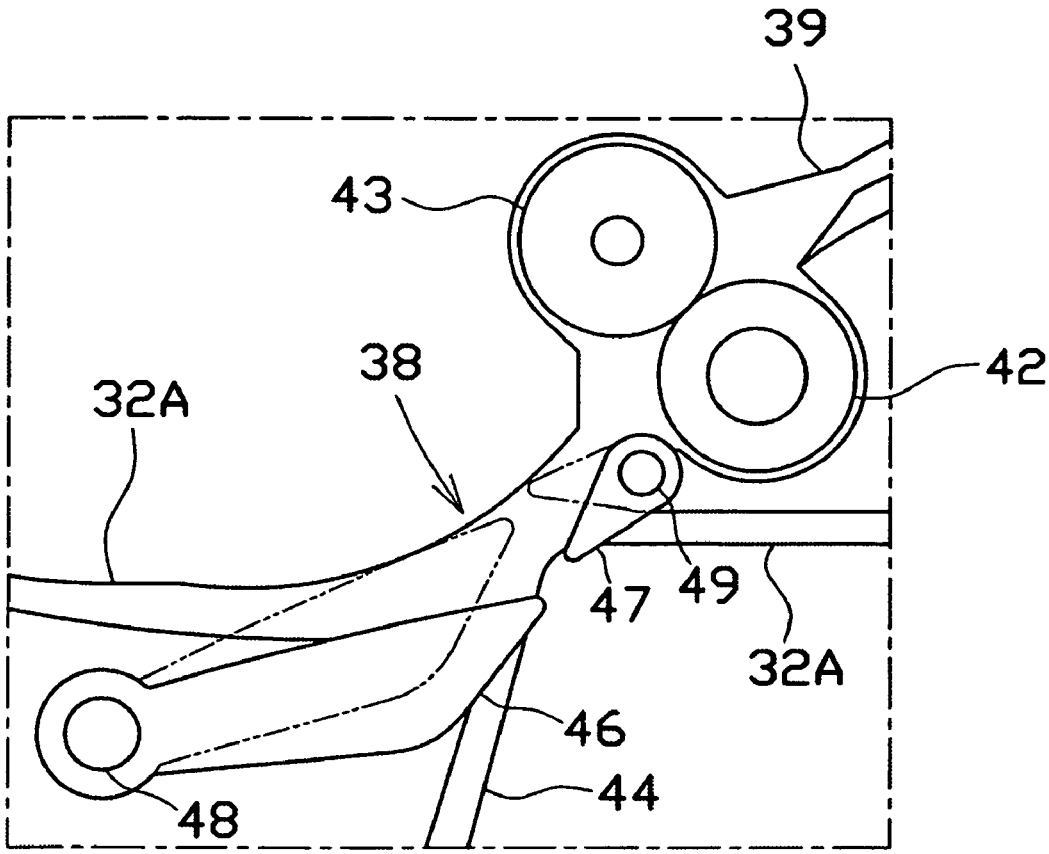
FIG. 3 is an enlarged view showing a structure at a connection position 38 according to at least one illustrative aspect of the invention.

As shown in FIGS. 1 and 3, guide flaps 46 (a first guide member) and 47 (a second guide member) for guiding the document to an appropriate feed path are disposed at the connection position 38. The guide flap 46 is pivotable in a specified range on a shaft 48, which is provided in a corner (lower left side in FIG. 3) in the connection position 38 where the reading position side of the document feed path 32 and the bypass 44 join. The guide flap 46 has a generally triangular shape, and its end projects to the connection position 38. Although only one guide flap 46 is shown in FIGS. 1 and 3, several guide flaps 46 may be provided at intervals along a width of the document feed path 32 if desired (a depth of the apparatus 1), and these multiple guide flaps 46 may be pivotable together with each other.

The guide flap 46 pivots on the shaft 48 to change its position between a first guide position shown by a solid line in FIG. 3 and a second guide position shown by a double dotted line in FIG. 3. When the guide flap 46 is placed in the first guide position, the feed path continues from the input tray 30 (right side in the figure) to the reading position (left side in the figure), whereas a feed path from the document feed path 32 to the bypass 44 (down side in the figure) is closed. With this structure, a document that has reached the connection position 38 from the input tray 30 of the document feed path 32 is allowed to go to the reading position side of the document feed path 32, and then directed to the bypass 44. In addition, a document that has reached the connection position 38 from the bidirectional feed path 39 is allowed to go to the reading position of the document feed path 32, and then directed to the bypass 44.

When the guide flap 46 is placed in the second guide position, a feed path continues from the bypass 44 to the bidirectional feed path 39 (upper side in the figure), whereas a feed path from the bypass 44 to the document feed path 32 is closed. Thus, a document that has reached the connection position 38 from the bypass 44 is allowed to go to the bidirectional feed path 39, and then directed to the reading position side of the document feed path 32.

Switching the feed path by the guide flap 46 takes place when the document contacts the guide flap 46. The guide flap 46 is biased to be located at the first guide position shown by the solid line in FIG. 3, e.g., under its own weight or as a result of undergoing an urging force, such as from an elastic member such as a spring. When a document being fed upward in the bypass 44 comes in contact with the guide flap 46, the guide flap 46 is pivoted upward and placed in the second guide position shown by the double dotted line in FIG. 3. On the contrary, when a document is fed from the bidirectional feed path 39 to the connection position 38, it comes in contact with the guide flap 46. However, as the guide flap 46 is set so that it does not move downward from the first guide position, the document is guided by the guide flap 46 to the reading position via the upper portion 32A of the document feed path 32. The guide flap 46 may be formed in a shape that allows the guide flap 46 to easily change its position by contact with a document being fed from the bypass 44 to the connection position 38, and to guide the document being fed from the bidirectional feed path 39 to the connection position 38 toward the reading position side of the document feed path 32. The guide flap 46 may be designed to change its position with application of power from a motor, not by contact with the document.

The guide flap 47 is pivotable in a specified range on a shaft 49, which is provided in a corner (upper right side in FIG. 3) in the connection position 38 where the input tray 30 side of the document feed path 32 and the bidirectional feed path 39 join. The guide flap 47 has a generally triangular shape, and its end projects to the connection position 38. Although only one guide flap 47 is shown in FIGS. 1 and 3, if desired, several guide flaps 47 may be provided at intervals along a width of the document feed path 32 (a depth of the apparatus 1), and these multiple guide flaps 47 may be pivotable together with one another.

The guide flap 47 pivots on the shaft 49 to change its position between a third guide position shown by a solid line in FIG. 3 and a fourth guide position shown by a double dotted line in FIG. 3. When the guide flap 47 is placed in the third guide position, a feed path from the bidirectional feed path 39 to the reading position side of the document feed path 32 continues, whereas a feed path from the bidirectional feed path 39 to the input tray 30 side of the document feed path 32 is closed. As a result, a document that has reached the connection position 38 from the bidirectional feed path 39 is allowed to go to the reading position side of the document feed path 32, but not to the input tray 30 side. In addition, a document that has reached the connection position 38 from the bypass 44 is allowed to go to the bidirectional feed path 39, but not to the input tray 30 side of the document feed path 32.

When the guide flap 47 is placed in the fourth guide position, a feed path from the input tray 30 side of the document feed path 32 to the reading position side continues, whereas a feed path from the input tray 30 side of the document feed path 32 to the bidirectional feed path 39 is closed. As a result, a document that has reached the connection position 38 from the input tray 30 side of the document feed path 32 is allowed to go to the reading position side of the document feed path 32, but not to the bidirectional feed path 39.

Switching the feed path by the guide flap 47 takes place when a document contacts the guide flap 47. The guide flap 47 is biased so as to be located at the third position shown in FIG. 3, e.g., under its own weight or as a result of undergoing an urging force of an elastic member such as a spring. A document being fed from the input tray 30 side of the document feed path 32 comes in contact with the guide flap 47, so that the guide flap 47 is pivoted leftward and placed in the fourth guide position by the double dotted line in FIG. 3. On the contrary, if a document that has reached the connection position 38 from the bypass 44 comes in contact with the guide flap 47, the guide flap 47 is set so that it does not move rightward from the third position. Thus, the document is guided by the guide flap 47 and goes to the bidirectional feed path 39. The guide flap 47 may be formed in a shape that allows the guide flap 47 to easily change its position by contact with a document being fed from the input tray 30 side of the document feed path 32 to the connection position 38, and to guide, toward the bidirectional feed path 39, the document being fed from the bypass 44 to the connection position 38. The guide flap 47 may be designed to change its position with application of power from a motor, not by contact with the document. In this illustrative embodiment, the guide flaps 46 and 47 are used as guide members at the connection position 38, however, flexible and deformable films may be used instead.

Figure 4:
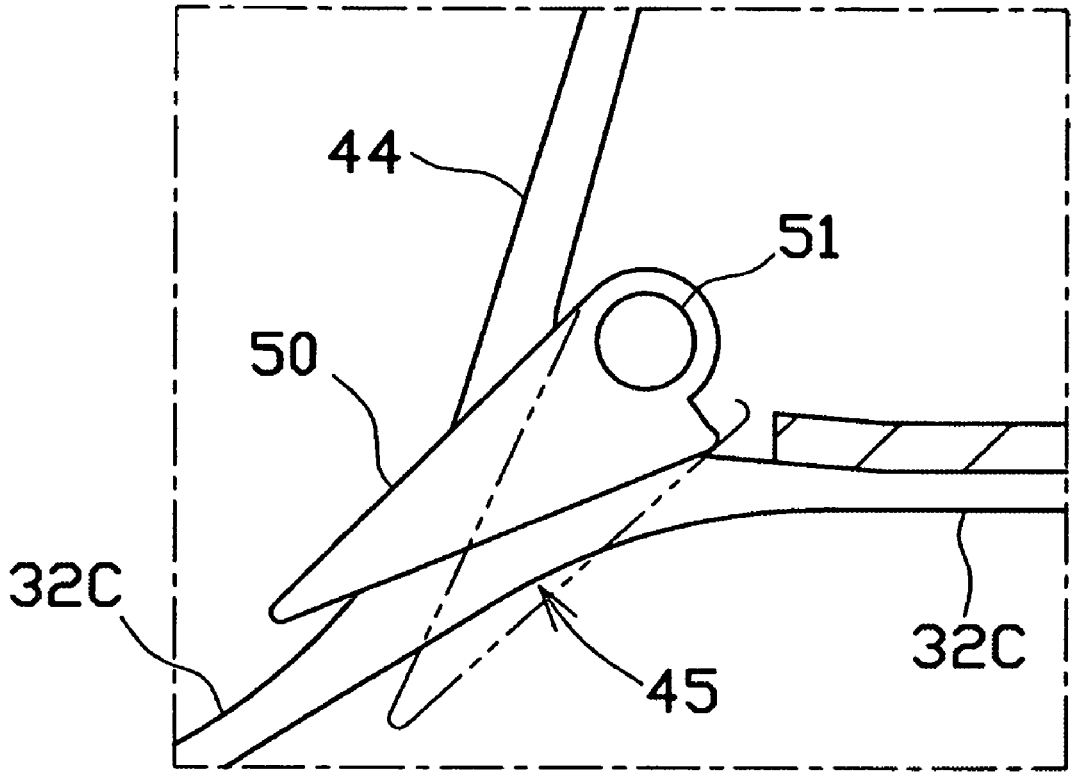
FIG. 4 is an enlarged view showing a structure at a branch position 45 according to at least one illustrative aspect of the invention.

As shown in FIGS. 1 and 4, a guide flap 50 is disposed at a branch position 45. The guide flap 50 is disposed so that it can pivot on a shaft 51. When power is transmitted from a motor to the guide flap 50, the guide flap 50 moves between a position shown by a solid line in FIG. 4 and a position shown by a double dotted line in FIG. 4. When the guide flap 50 is placed in the position shown by the solid line, the document feed path 32 continues from the reading position side (left side in the figure) to the output tray 31 side (right side in the figure). Thus, a document passing the reading position is guided at the branch position 45 to go to the lower portion 32C of the document feed path 32 continuing toward the output tray 31. When the guide flap 50 is placed in the position shown by the double dotted line, the feed path from a downstream side of the reading position in the lower portion 32C of the document feed path 32 to the bypass 44 continues. By this path, the document that has passed the reading position is guided at the branch position 45 to go to the bypass 44. In this way, the guide flap 50 is disposed to guide the document at the branch position 45 to either the document feed path 32 or the bypass 44. Although only one guide flap 50 is shown in FIGS. 1 and 4, if desired, several guide flaps 50 may be provided at intervals along a width of the document feed path 32, and these multiple guide flaps 50 may be rotated together with each other.

As shown in FIG. 1, a plurality of sensors for detecting conveyance of a document may be provided along the document feed path 32 and the bypass 44. Specifically, the document feed path 32 includes a first front sensor 52 and a second front sensor 53 on upstream and downstream sides of the separation roller 34, respectively, and a rear sensor 54 on a directly upstream side of the reading position. The bypass 44 includes a bidirectional feed sensor 55. These sensors are so called optical sensors and have identical structures except for that their detection element shapes are different according to positions for detection. Thus, the following description will be made using the first front sensor and the second front sensor.

Figure 5:
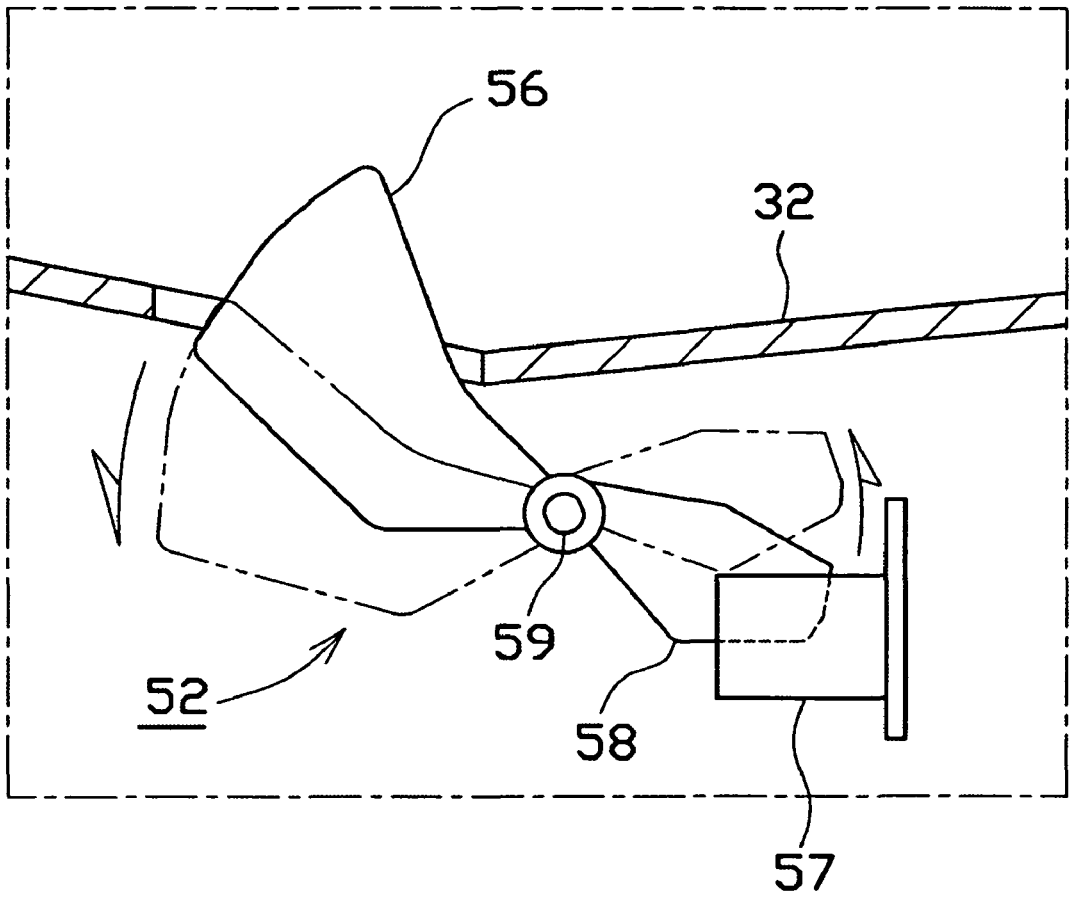
FIG. 5 is an enlarged view showing a structure of a first front sensor 52 according to at least one illustrative aspect of the invention.

As shown in FIG. 5, the first front sensor 52 includes a detection element 56 configured to protrude from underside of the document feed path 32 and rotate in contact with a document so as to withdraw from the document feed path 32, and a photo interrupter 57 configured to detect rotation of the detection element 56. The detection element 56 is integrally formed with a shield portion 58 that is detected by the photo interrupter 57. The detection element 56 is provided rotatably on a shaft 59. The detection element 56 is elastically urged by an urging member such as a spring into a position where the detection element 56 protrudes from the document feed path 32, that is, the detection element 56 is elastically urged counterclockwise in FIG. 5. When external force is not applied to the detection element 56, the detection element 56 protrudes from the document feed path 32 as shown by the solid line in FIG. 5, and the shield portion 58 is placed between a light emitting portion and a light receiving portion of the photo interrupter 57. Thus, light transmission from the photo interrupter 57 is interrupted, and the first front sensor 52 is turned off.

When a document is placed in the input tray 30, the document contacts the detection element 56, and the detection element 56 is rotated to withdraw from the document feed path 32. The shield portion 58 is also rotated along with the detection element 56, and separates from between the light emitting portion and the light receiving portion of the photo interrupter 57 as shown by the double dotted line in FIG. 5. Thus, light transmission of the photo interrupter 57 is not interrupted, and the first front sensor 52 is turned on. By on/off of the first front sensor 52, it is detected whether a document is placed in the input tray 30.

The second front sensor 53 is disposed directly downstream from the separation roller 34 and is configured to detect the leading or trailing end of the document fed in the document feed path 32 by on/off. For example, a determination whether the trailing end of a document has passed the connection position 38 is made by monitoring the number of rotations of the feed rollers 35A, 35B, 35C, and 35D, after the second front sensor 53 detects the trailing end of the document, e.g., with an encoder or the number of motor steps.

The rear sensor 54 is disposed directly upstream of the reading position and is configured to detect the leading or trailing end of a document fed in the document feed path 32 by on/off. A determination whether the leading or trailing end of the document has reached the reading position is made by monitoring the number of rotations of the feed rollers 35A, 35B, 35C, and 35D, after the rear sensor 54 detects the leading or trailing end of the document, e.g., with an encoder or the number of motor steps. Image reading by the image reading unit 22 is controlled based on a signal of the rear sensor 54. Image reading is started when the leading end of the document has reached the reading position, and it ends when the trailing end has reached the reading position.

The bidirectional feed sensor 55 is disposed in the bypass 44 and is configured to detect the leading or trailing end of the document fed in the bypass 44 by on/off. For example, a determination whether the trailing end of a document has passed the connection position 38 may be made by monitoring the number of rotations of the feed rollers 35A, 35B, 35C, and 35D and the bidirectional feed roller 42, after the bidirectional feed sensor 55 detects the trailing end of the document, e.g., with an encoder or the number of motor steps.

The following will describe an example image reading operation of the image reading apparatus 1 according to the figures described above.

Although the image reading apparatus 1 can be used both as a FBS and with the ADF 3, detailed description of the FBS usage will be omitted because the FBS is not particularly related to this invention. Conventional operation of the system as a FBS may be used without departing from this invention. If the ADF 3 is used, the document cover 4 should be closed against the document mounting table 2. Opening and closing of the document cover 4 may be detected by a sensor provided on or with the document mounting table 2, and the document cover 4 may be controlled so that, when it is closed, the ADF 3 is available. The ADF cover 27 should be closed. A document G to be read is placed on the input tray 30. The document G is placed on the input tray 30 with a surface to be read (also called a "first surface") thereof face up. The document G may be one sheet or a stack of sheets. For example, when documents G of a given size are read, they may be stacked neatly on the input tray 30 with the first surface of each document GI face up.

When a reading start is inputted in the image reading apparatus 1, the motor is driven, and the pickup roller 33, the separation roller 34, the feed rollers 35A, 35B, 35C, 35D, the ejection roller 36, and the bidirectional feed roller 42 are rotated at their respective timings. When the arm 29 is lowered, the pickup roller 33 is pressed in contact with the document G on the input tray 30. Starting from the document G, which is placed in an uppermost position and is directly subjected to the rotation of the pickup roller 33 and the separation roller 34, the documents G are singly separated from the stack and fed into the document feed path 32. The picked up document G is guided into the document feed path 32 to go to the reading position, and read by the image reading unit 22 remaining at rest under the reading position. The read document G is ejected to the output tray 31. In this image reading operation, the feed path of the documents G is different between single-side reading and double-sided reading operations. Reading one side or both sides of the document G is determined in advance before the reading start is inputted.

Figure 6:
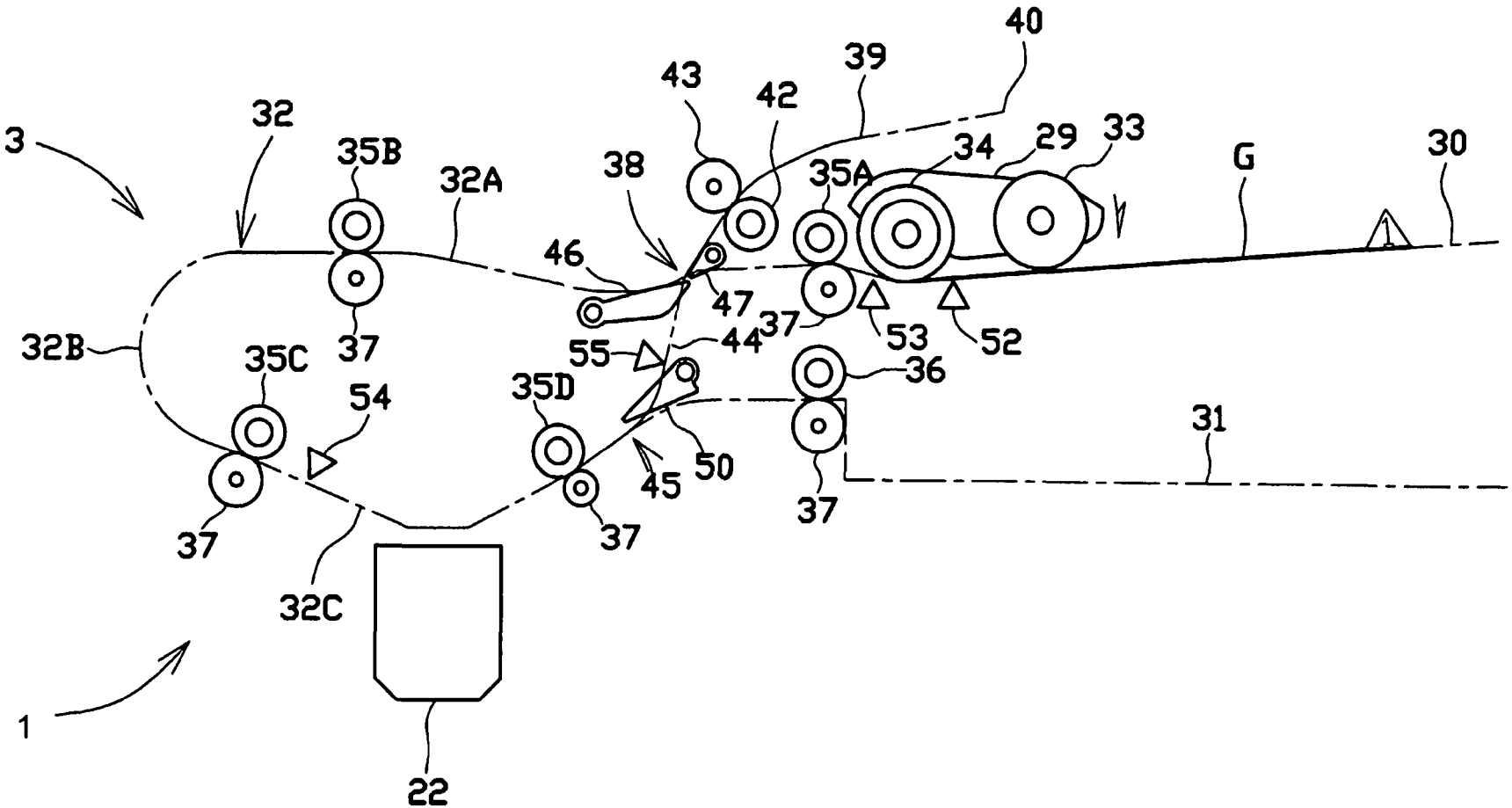
FIG. 6 schematically illustrates an image reading operation by the image reading apparatus 1 according to at least one illustrative aspect of the invention.

The single-side reading will be described. As shown in FIG. 6, the guide flap 50 is positioned at the branch position 45 so that the document feed path 32 continues from the reading position side to the output tray 31 side. The guide flap 46 is positioned in the first guide position when it does not contact with the document G. That is, the guide flap 46 is positioned at the connection position 38 so that the document feed path 32 continues from the input tray 30 side to the reading position side. The guide flap 47 is positioned in the third guide position when it does not contact with the document G. That is, the guide flap 47 is positioned at the connection position 38 so that the feed path continues from the bidirectional feed path 39 to the reading position side of the document feed path 32.

When the reading start is inputted into the image reading apparatus 1, the first front sensor 52 detects whether a document G is placed on the input tray 30. When no document G is placed on the input tray 30, an error message "no document" appears on a display portion of the image reading apparatus 1. When a document G is placed on the input tray 30, a driving force is transmitted from the motor to the arm 29, and the arm 29 is lowered. Then, the pickup roller 33 is pressed in contact with the document G on the input tray 30. When the pickup roller 33 and the separation roller 34 rotate, the document G is fed into the document feed path 32. When a stack of documents G is placed on the input tray 30, a document that is placed directly under the uppermost document G may be fed together therewith. However, the document is restrained by the separation pad provided opposing the separation roller 34.

In the document feed path 32, power is transmitted from the motor to the feed rollers 35A, 35B, 35C, 35D, and the ejection roller 36, and each roller rotates so as to feed the document G from the upstream side of the document feed path 32 to the downstream side. The document G is picked up from the input tray 30, fed into the document feed path 32, nipped between the feed roller 35A and the pinch roller 37 in which the rotational force is transmitted to the document G, and fed to the connection position 38 of the document feed path 32.

Figure 7:
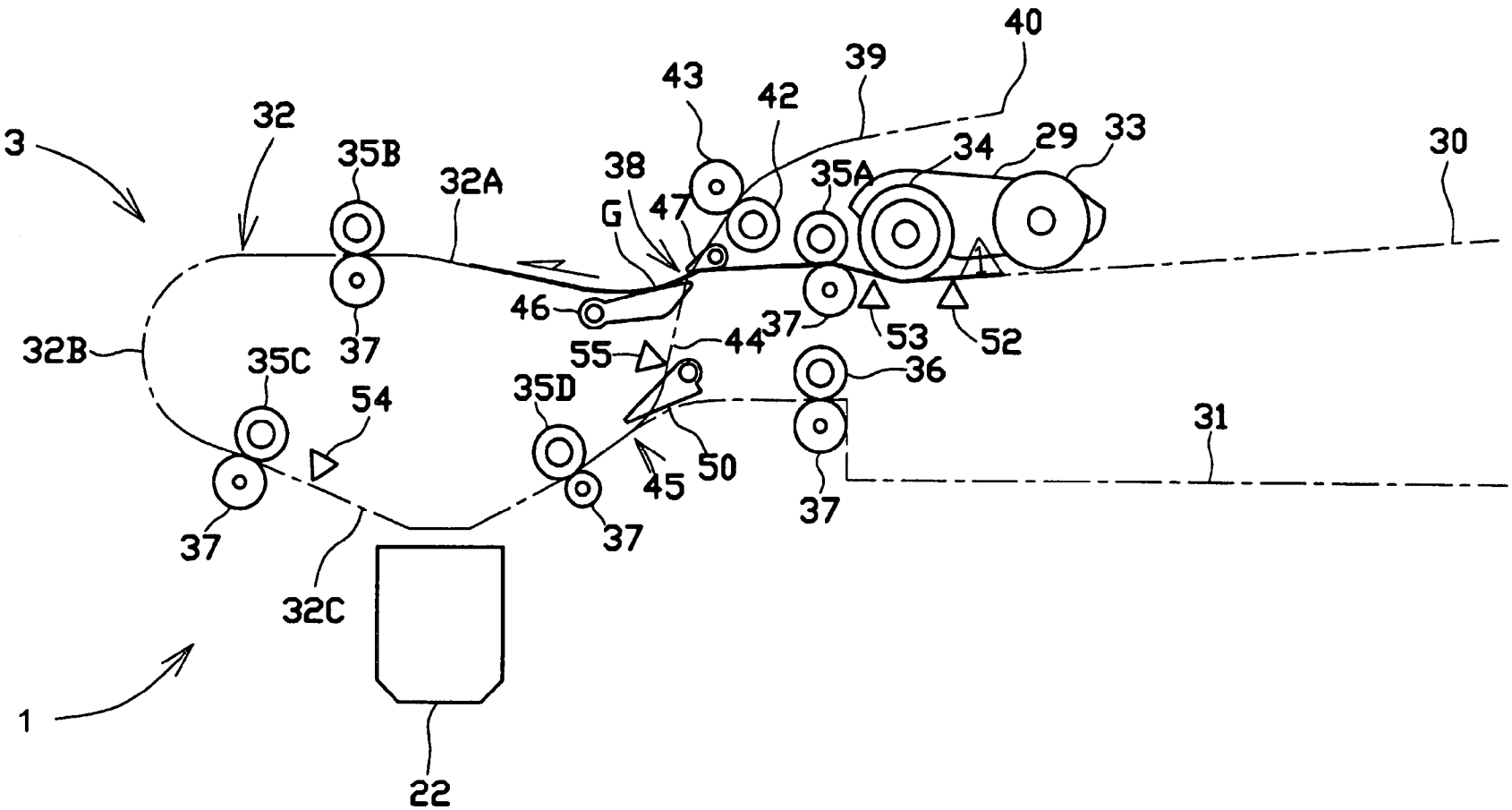
FIG. 7 schematically illustrates an image reading operation by the image reading apparatus 1 according to at least one illustrative aspect of the invention.

As the guide flap 47 closes the document feed path 32 from the input tray 30 side to the connection position 38, the document G being fed to the connection position 38 comes in contact with the guide flap 47. As shown in FIG. 7, the guide flap 47 is pushed by the document G being fed in the document feed path 32 and pivoted from the third guide position to the fourth guide position. As a result, the document feed path 32 continues from the input tray 30 to the reading position, whereas the path to the bidirectional feed path 39 is closed. In addition, the feed path to the bypass 44 is closed by the guide flap 46. As a result, the document G that has reached the connection position 38 from the input tray 30 side of the document feed path 32 is guided by the guide flaps 46, 47, and fed to the reading position of the document feed path 32, without going to the bidirectional feed path 39 or the bypass 44.

Figure 8:
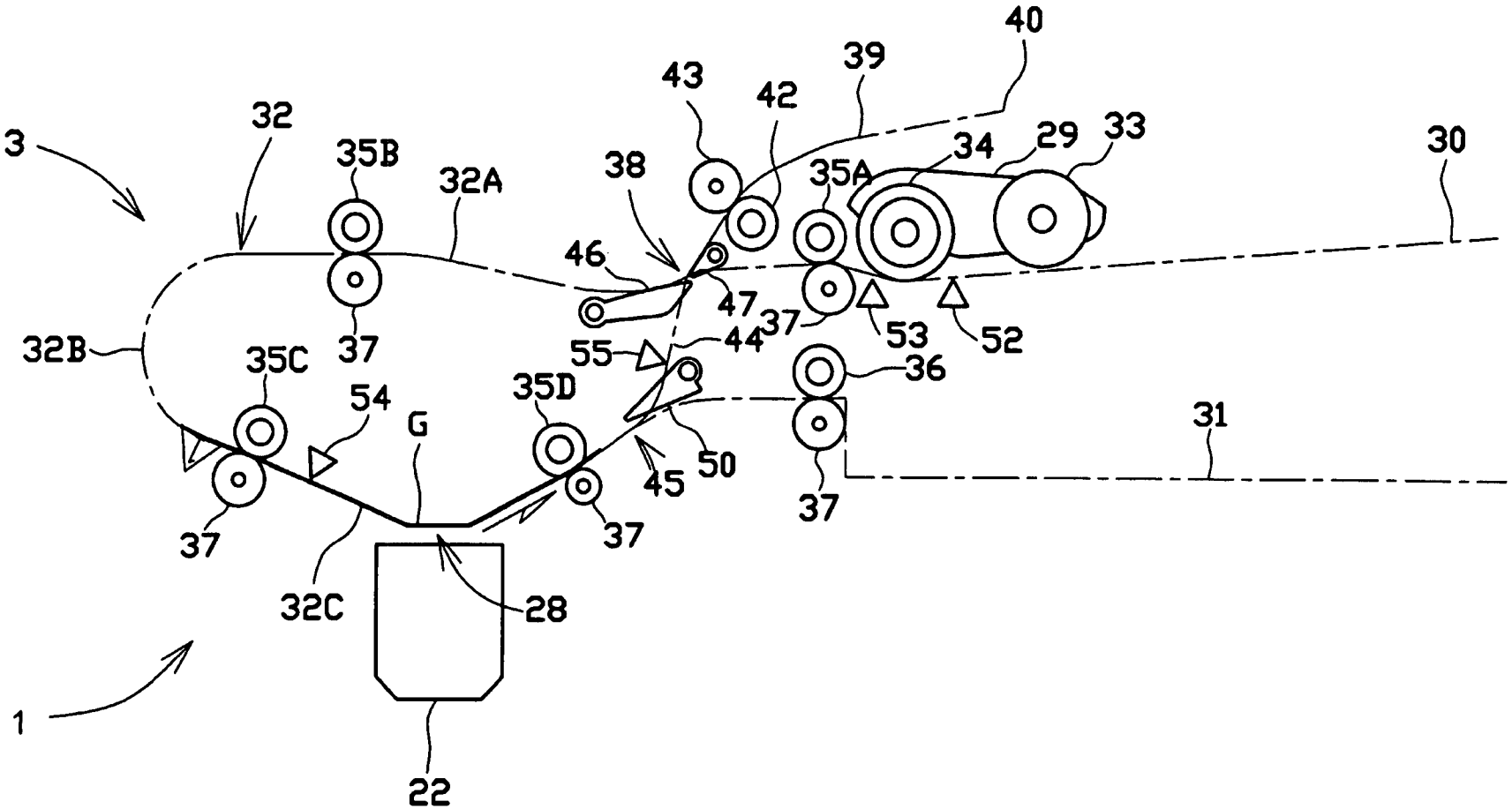
FIG. 8 schematically illustrates an image reading operation by the image reading apparatus 1 according to at least one illustrative aspect of the invention.

As shown in FIG. 8, the document G is inverted downward at the curved portion 32B, and the leading end of the document G is detected by the rear sensor 54. The leading end of the document G reaches the reading position when a fixed time passes after being detected by the rear sensor 54. When the leading end of the document G reaches the reading position, the image reading unit 22 starts image reading of the document G. The document G passes the reading position with the first surface opposing the image reading unit 22, and the image on the first surface of the document G is read by the image reading unit 22. The image reading unit 22 finishes image reading of the document G when a fixed time passes after the trailing end of the document G is detected by the rear sensor 54. When the trailing end of the document G passes the connection position 38, the guide flap 47 returns from the fourth guide position to the third guide position.

Figure 9:
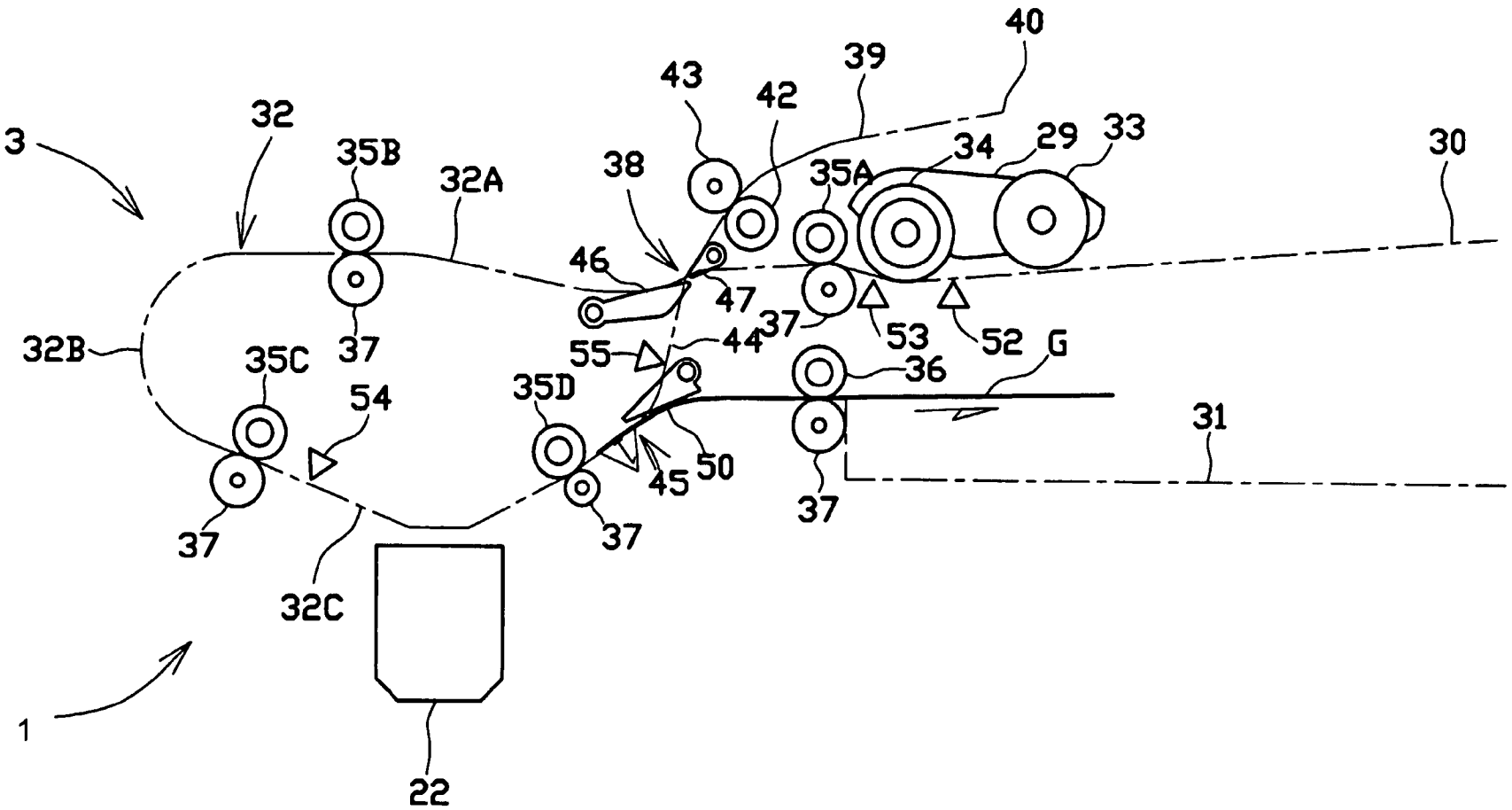
FIG. 9 schematically illustrates an image reading operation by the image reading apparatus 1 according to at least one illustrative aspect of the invention.

As shown in FIG. 9, the document G is guided at the branch position 45 by the guide flap 50 toward the output tray 31 side of the document feed path 32. The document G is nipped between the ejection roller 36 and the pinch roller 37, and then ejected from the document feed path 32 to the output tray 31. When the following document G is set on the input tray 30, it is singly picked up and fed from the input tray 30, and the single surface of the document G is read by repeating the above operations.

The following describes double-sided reading. Before the document G is fed, as shown in FIG. 6 in the description of single-side reading, the guide flap 50 is positioned at the branch position 45 so that document feed path 32 continues from the reading position to the output tray 31. The guide flap 46 is positioned in the first guide position. That is, the guide flap 46 is positioned at the connection position 38 so that the document feed path 32 continues from the input tray 30 side to the reading position side. The guide flap 47 is positioned in the third guide position. That is, the guide flap 47 is positioned at the connection position 38 so that the feed path continues from the bidirectional feed path 39 to the reading position side of the document feed path 32.

When the reading start is inputted into the image reading apparatus 1, as is the case with single-side reading, the first front sensor 52 detects whether a document G is placed on the input tray 30, the arm 29 is lowered, the pickup roller 33 and the separation roller 34 are rotated, and the document G is fed into the document feed path 32.

In the document feed path 32, the feed rollers 35A, 35B, 35C, 35D are rotated so as to feed the document G from the upstream side to the downstream side, the document G is fed from the input tray 30 to the document feed path 32 to go to the connection position 38. At the connection position 38, as shown in FIG. 7 in the description of single-side reading, the guide flap 47 is pushed by the document G being fed in the document feed path 32 and pivoted from the third guide position to the fourth guide position. As a result, the document feed path 32 continues from the input tray 30 to the reading position, whereas the path to the bidirectional feed path 39 is closed. In addition, the feed path to the bypass 44 is closed by the guide flap 46. As a result, the document G that has reached the connection position 38 from the input tray 30 side of the document feed path 32 is guided by the guide flaps 46, 47, and fed to the reading position of the document feed path 32, without going to the bidirectional feed path 39 or the bypass 44.

As shown in FIG. 8 in the description of single-side reading, the document G is inverted downward at the curved portion 32B, and the leading end of the document G is detected by the rear sensor 54. The leading end of the document G reaches the reading position when a fixed time passes after being detected by the rear sensor 54. When the leading end of the document G reaches the reading position, the image reading unit 22 starts image reading of the document G. The document G passes the reading position with the first surface opposing the image reading unit 22, and the image on the first surface of the document G is read by the image reading unit 22. The image reading unit 22 finishes image reading of the document G when a fixed time passes after the trailing end of the document G is detected by the rear sensor 54.

The guide flap 50 changes the feed path at the branch position 45 to continue from the reading position of the document feed path 32 to the bypass 44 before the leading end of the document G reaches the branch position 45 of the document feed path 32. Timing for the guide flap 50 to change the feed path is optional and may be set before the document G is fed. When the trailing end of the document G passes the connection position 38, the guide flap 47 returns from the fourth guide position to the third guide position.

Figure 10:
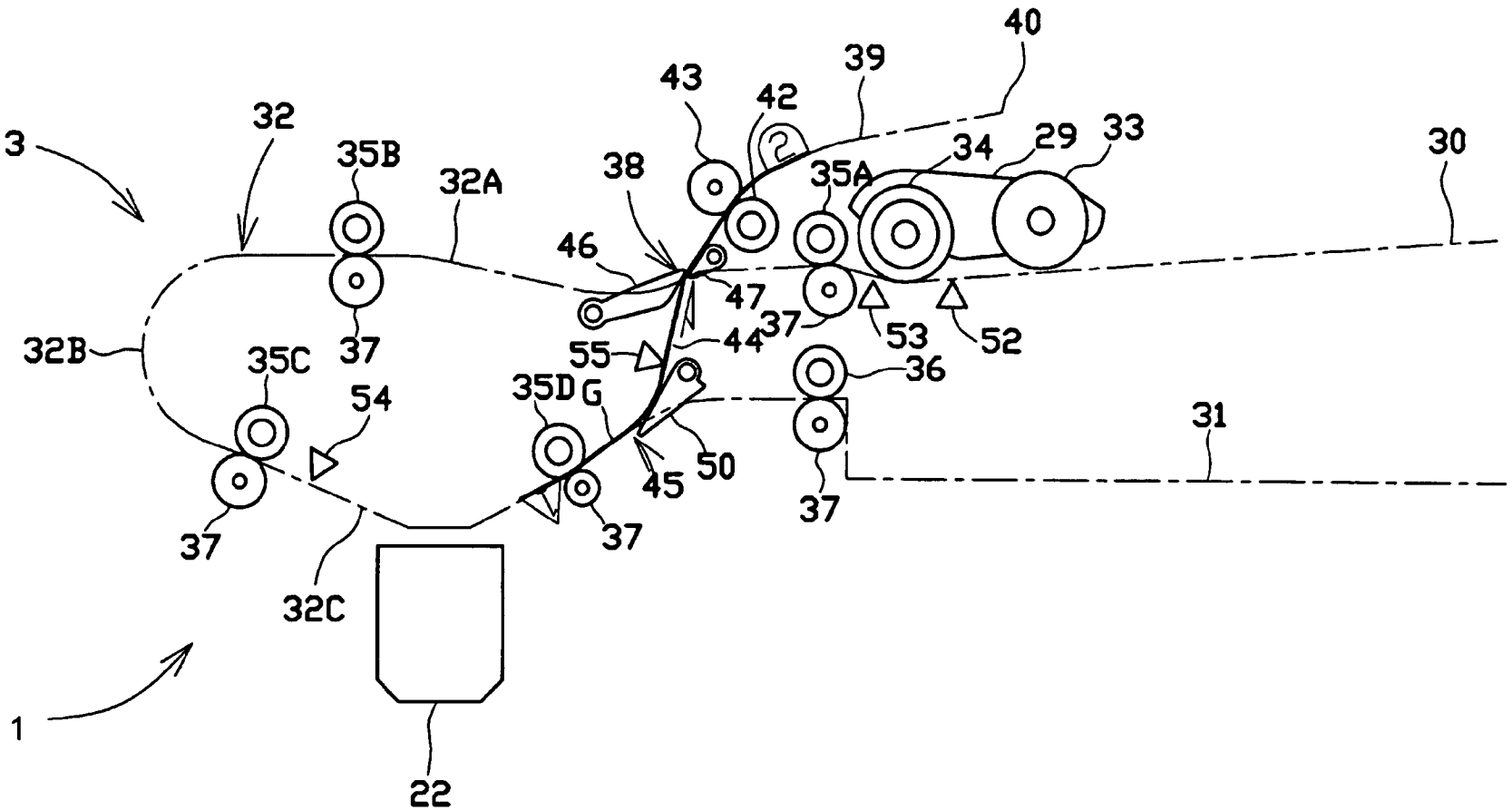
FIG. 10 schematically illustrates an image reading operation by the image reading apparatus 1 according to at least one illustrative aspect of the invention.

As shown in FIG. 10, the document G of which the first surface has been read is guided by the guide flap 50 to go to the bypass 44 at the branch position 45. As the guide flap 46 closes the feed path from the bypass 44 to the connection position 38, the document G entering the bypass 44 comes in contact with the guide flap 46 when it reaches the connection position 38. The guide flap 46 is pushed by the document G being fed in the bypass 44 and pivots upward from the first guide position to the second guide position as shown in FIG. 10. Thus, the feed path from the bypass 44 to the bidirectional feed path 39 continues, whereas the path to the reading position of document feed path 32 is closed. In addition, the feed path to the input tray 30 of the document feed path 32 is closed by the guide flap 47. As a result, the document G that has reached the connection position 38 from the bypass 44 is guided by the guide flaps 46, 47, and fed to the bidirectional feed path 39 without going to the document feed path 32. The document G is nipped between the bidirectional feed roller 42 and the pinch roller 43, and it is fed to the termination 40 on the bidirectional feed path 39 due to the rotation of the bidirectional feed roller 42. In figures, a surface of a document G indicated with the number "1" refers to the first surface of the document G, which is to be read first in the double-sided reading, and a surface indicated with the number "2" refers to the second surface of the document G, which is to be read next in the double-sided reading. The first surface and the second surface are the front side and back side, respectively, of the document G.

Figure 11:
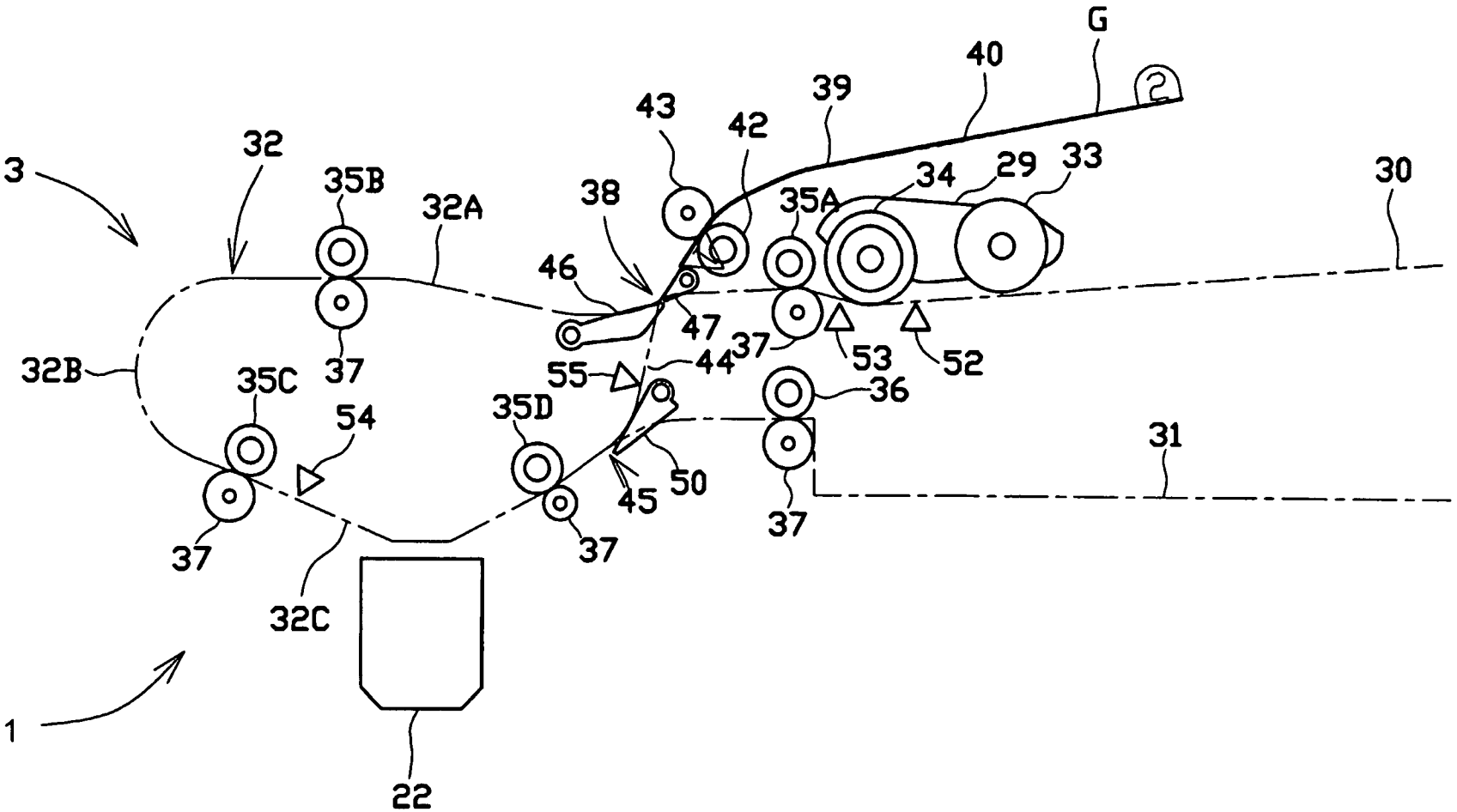
FIG. 11 schematically illustrates an image reading operation by the image reading apparatus 1 according to at least one illustrative aspect of the invention.

As shown in FIG. 11, the trailing end of the document G passes over the connection position 38 and completely goes to the bidirectional feed path 39, and the bidirectional feed roller 42 is stopped. Specifically, the trailing end of the document G passes over the connection position 38 when a fixed time passes after the trailing end of the document G being fed in the bypass 44 is detected by the bidirectional feed sensor 55. Thus, it is determined that the document G completely enters the bidirectional feed path 39 by counting a detection signal by the bidirectional feed sensor 55, and a feeding length or time by the bidirectional feed roller 42. Then, the bidirectional feed roller 42 is stopped, and the document G is stopped while still remaining nipped between the bidirectional feed roller 42 and the pinch roller 43 as shown in FIG. 11. At this time, although a part of the document G protrudes from the termination 40 of the bidirectional feed path 39 outside of the ADF 3, it is supported by the document supporting portion 41.

As the document G passes over the connection position 38 and separates from the guide flap 46, the guide flap 46 pivots downward and returns to the first guide position. Then, the bidirectional feed roller 42 is rotated backward, so that the document G is fed back to the connection position 38 on the bidirectional feed path 39.

Figure 12:
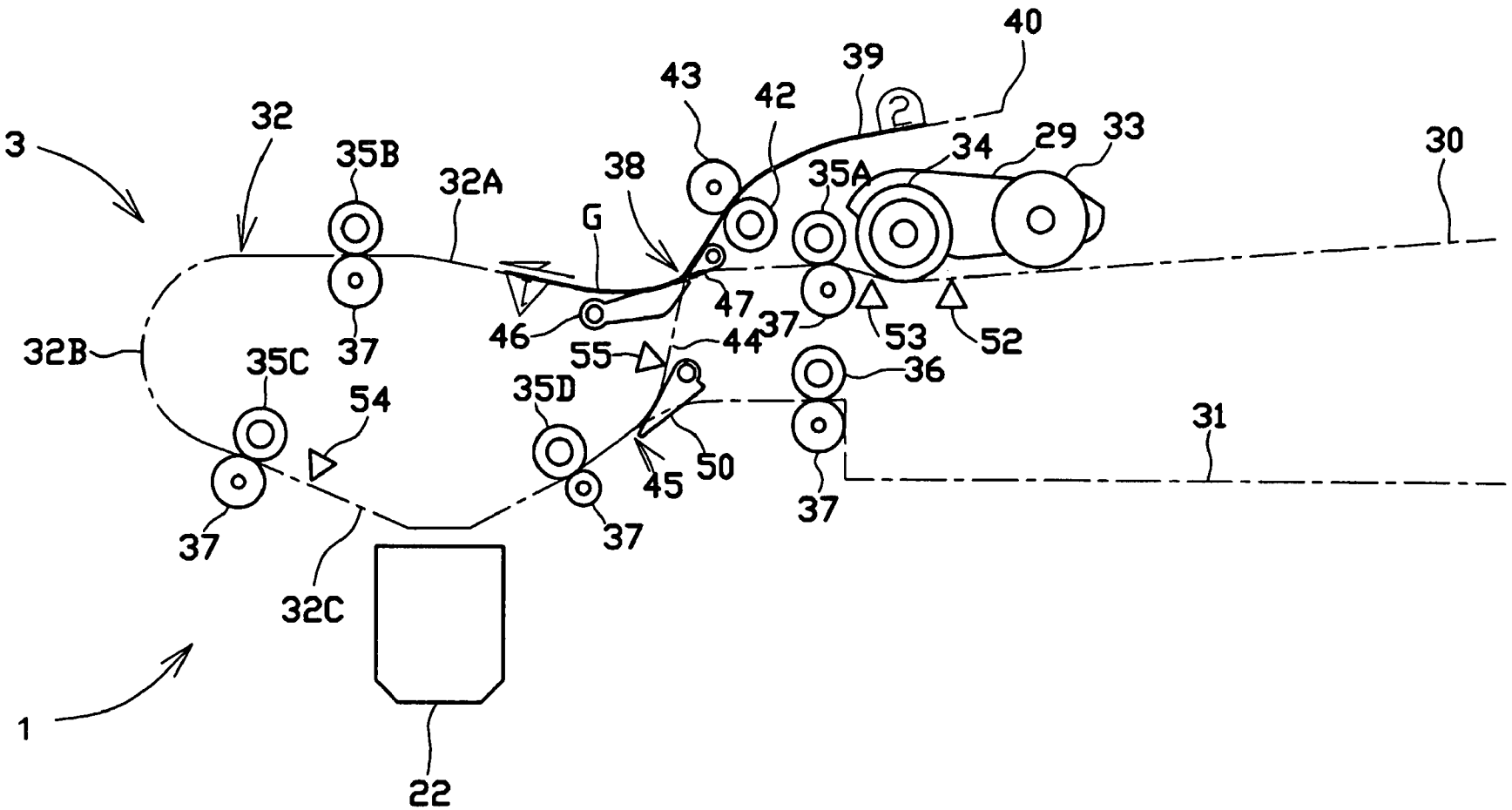
FIG. 12 schematically illustrates an image reading operation by the image reading apparatus 1 according to at least one illustrative aspect of the invention.

As shown in FIG. 12, the document G being fed back from the bidirectional feed path 39 comes in contact with the guide flap 46 at the connection position 38. The guide flap 46 does not move downward from the first guide position. Thus, the feed path from the bidirectional feed path 39 to the reading position of the document feed path 32 continues, whereas the path to the bypass 44 is closed. The guide flap 47 closes the feed path to the input tray 30 side of the document feed path 32. As a result, the document G is guided by the guide flaps 46 and 47, and fed from the bidirectional feed path 39 to the reading position of the document feed path 32, without going to the bypass 44 nor to the input tray 30 side of the document feed path 32. When the document G is fed back to the upstream side of the reading position of the document feed path 32 from the bidirectional feed path 39, it is fed back to the document feed path 32 with its leading end and trailing end reversed as compared with the condition where the document G was first fed into the document feed path 32. In this way, the document G is fed back. The document G is fed into the document feed path 32 with its second surface facing the reading position.

Figure 13:
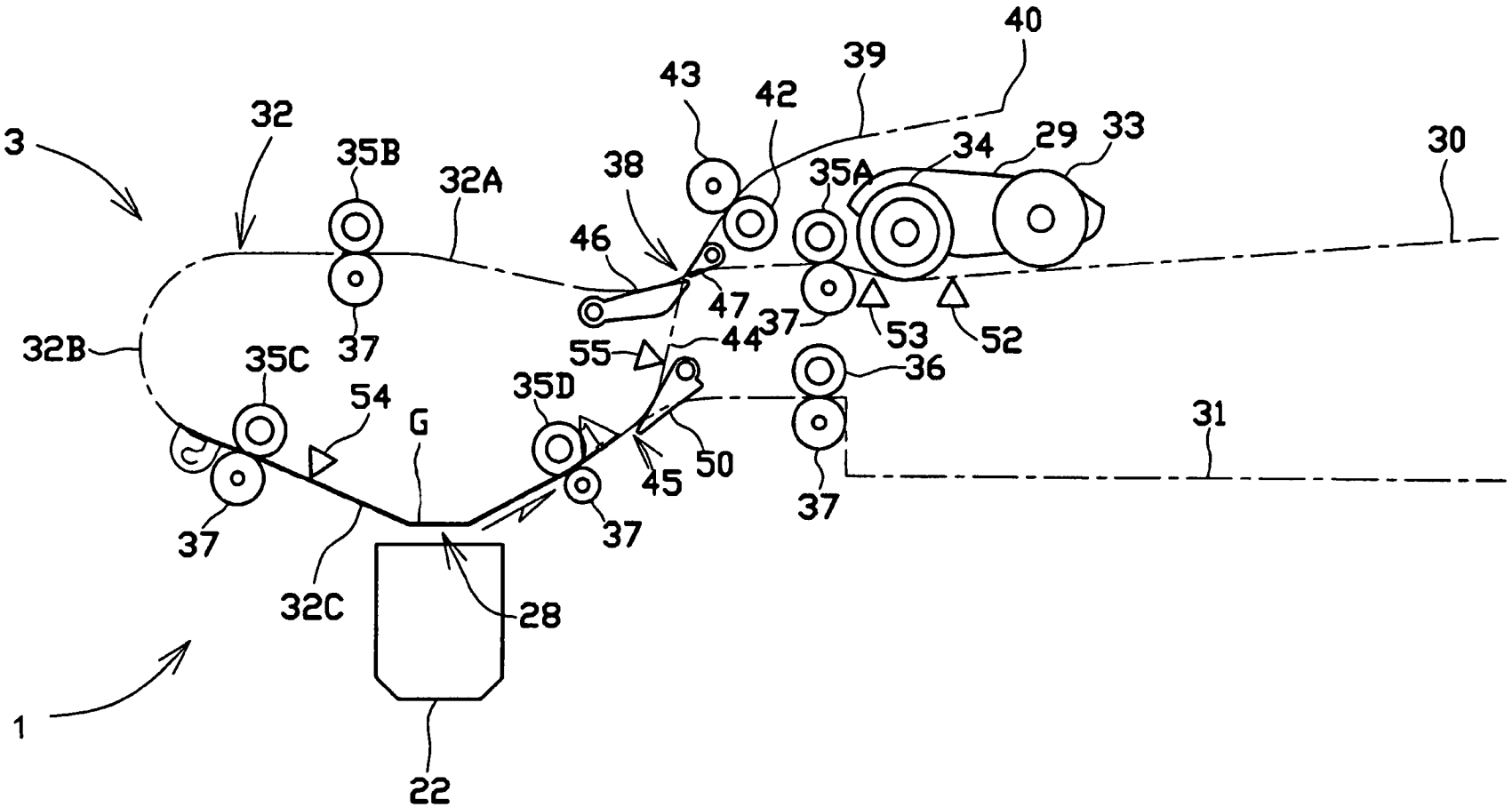
FIG. 13 schematically illustrates an image reading operation by the image reading apparatus 1 according to at least one illustrative aspect of the invention.

As shown in FIG. 13, when the leading end of the document G is detected by the rear sensor 54 and reaches the reading position, the image reading unit 22 starts image reading of the second surface of the document G. The document G of which the second surface has been read then is guided by the guide flap 50, and it enters the bypass 44 from the document feed path 32 at the branch position 45. When the trailing end of the document G is detected by the rear sensor 54 and reaches the reading position, the image reading unit 22 finishes image reading of the document G.

The document G entering the bypass 44 pushes the guide flap 46 upward to change its position from the first guide position to the second guide position as is the case with FIG. 10, and the document G goes to the bidirectional feed path 39 from the bypass 44 at the connection position 38. As is the case with FIG. 11, after the trailing end of the document G passes the connection position 38 and completely goes to the bidirectional feed path 39, the bidirectional feed roller 42 stops. The guide flap 46 returns to the first guide position from the second guide position when the document G passes. Then, the bidirectional feed roller 42 is rotated backward, the document is fed back to the document feed path 32 from the bidirectional feed path 39, as is the case with FIG. 12, with its leading end and trailing end reversed again.

The guide flap 50 switches the feed path at the branch position 45 from the reading position side of the document feed path 32 to the output tray 31 side while the leading end of the document G reaches the branch position 45 of the document feed path 32 after it is fed back. The guide flap 50 may switch the feed path when the bidirectional feed roller 42 is rotated backward. Thus, as is the case with FIG. 9, the document G is guided at the branch position 45 by the guide flap 50 to go to the output tray 31 side of the document feed path 32, and is ejected to the output tray 31 with its first surface face down. When the following document G is set on the input tray 30, it is singly picked up and fed from the input tray 30, and image reading of both surfaces of the document G is performed by repeating the above operations. As documents G are sequentially ejected to the output tray 31 with their first surface face down, the order of the documents G placed on the input tray 30 is maintained on the output tray 31.

In this illustrative embodiment, double-sided reading by the image reading apparatus 1 has been described based on the assumption that the user desires the documents G placed on the input tray 30 to be ejected to the output tray 31 in an orderly sequence. However, if there is no need to match the sequence of the documents G placed on the input tray 30 to the sequence of the documents G ejected to the output tray 31, the documents G may be fed to the reading position with their second surface facing the reading position, fed not to the bypass 44, but rather to the output tray 31 at the branch position 45, and then ejected to the output tray 31. With this structure and arrangement, whereas the sequence of the documents G is not maintained at the output tray 31, the last operation, feeding back the documents for the second inversion process, can be eliminated, and the time taken for double-sided reading of the documents G can be reduced.

The documents G may be jammed during feeding for single-side or double-sided reading by the ADF 3. For example, when a jam occurs while the document G is fed near the ejection roller 36 in the lower portion 32C of the document feed path 32 as shown in FIG. 9, the document G partially exposed to the output tray 31 is pulled out, and the jam is cleared. If a jam occurs while the document G passes the opening 28 in the lower portion 32C of the document feed path 32 as shown in FIG. 8, the document cover 4 is opened to expose the opening 28, the document G is pulled from the opening 28, and the jam is cleared. If a jam occurs while the document G protrudes from the termination 40 of the bidirectional feed path 39 as shown in FIG. 11, the document G partially protruding from the termination 40 is pulled out and the jam is cleared.

As shown in FIGS. 7, 10 and 11, if a jam occurs while the document G is completely inside the ADF 3, the inside of the ADF 3 should be exposed.

As shown in FIG. 2, when the ADF cover 27 is moved in the open position, the upper portion 32A and a part of the curved portion 32B of the document feed path 32 are exposed. If a jam occurs while at least a part of the document G is fed in the upper portion 32A and the part of the curved portion 32B as shown in FIGS. 7 and 12, the ADF cover 27 is opened to expose the document G. Thus, the exposed document G is pulled out in the state shown in FIGS. 7 and 10, so that the jam is cleared. In addition, when the ADF cover 27 is moved in the open position, a part of the bidirectional feed path 39, which starts from a position corresponding to where the bidirectional feed roller 42 and the pinch roller 43 are disposed toward the termination 40, is also moved along with the ADF cover 27. As shown in FIG. 10, if the document G approaches the termination 40 beyond the bidirectional feed roller 42 and the pinch roller 43, a part of the document G is exposed by opening the ADF cover 27. Thus, the exposed document G is pulled out in the state shown in FIG. 10, so that the jam is cleared.

As shown in FIG. 1, the distance D of the document feed path 32 from the feeding roller 35A and its corresponding pinch roller 37 to the feeding roller 35B and its corresponding pinch roller 37 is shorter than 210 mm, which is a length of A5 size when A5 is the smallest size for a document the ADF 3 is capable of feeding. The distance D is longer than 182 mm, which is a length of B6 size when B6 is the smallest size for a document the ADF 3 is capable of feeding. Thus, even if a document G smaller than A5 is supplied in the document feed path 32 from the input tray 30, the document G surely remains between the feeding roller 35 and its corresponding pinch roller 37 in the upper portion 32A of the document feed path 32. When the ADF cover 27 is opened, the feeding roller 35, the feeding roller 35B, and the upper portion 32A of the feed document path 32 where these rollers are disposed, are exposed. Thus, even if the user mistakenly supplies a documents G whose size is smaller than the smallest size the ADF 3 can handle, the document G surely remains in the upper portion 32A of the document feed path 32, and thus can be readily removed by opening the ADF cover 27.

According to the image reading apparatus 1, by opening the ADF cover 27 provided to be opened and closed with respect to the ADF frame 26, the document feed path 32 from the connection position 38 of the upper portion 32A to a part of the curved portion 32B is released. Thus, only by opening and closing operations of the ADF cover 27, paper jam in the upper portion 32A and the curved portion 32B of the document feed path 32 and the bidirectional feed path 39 can be cleared.

In the illustrative embodiment, a part of the bidirectional feed path 39 where the bidirectional feed roller 42 and the pinch roller 43 are disposed is designed to remain on the ADF frame 26 side even when the ADF cover 27 is rotated. However, the bidirectional feed path 39 may be moved along with the ADF cover 27.

Figure 14:
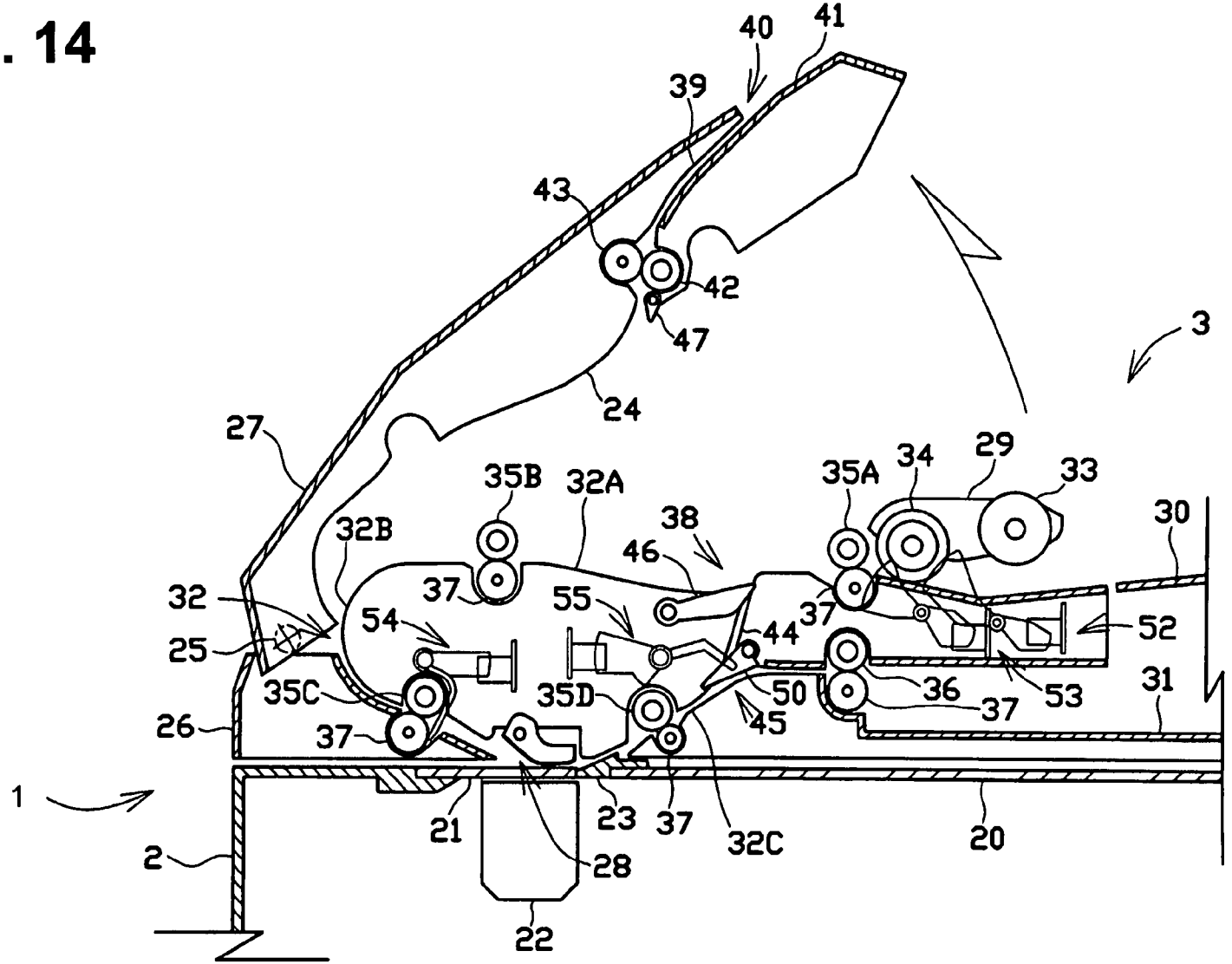
FIG. 14 schematically illustrates an image reading operation by the image reading apparatus 1 according to at least one illustrative aspect of the invention.

Specifically, as shown in FIG. 14, the structure of the bidirectional feed path 39 including the bidirectional feed roller 42 and pinch roller 43 may be fixed to and rotated along with the ADF cover 27. Thus, when the ADF cover 27 is opened, the bidirectional feed path 39 is separated from the connection position 38 along with the ADF cover 27. As a result, the document feed path 32 from a vicinity of the feeding roller 35A via the connection position 38 and the upper portion 32A to the curved portion 32B is released, and at least a part of the document G is exposed in any case shown in FIGS. 7, 10, and 12. Thus, a paper jam in the document feed path 32 and the bidirectional feed path 39 can be cleared. Especially, as the connection position 38 where the document G is fed in three directions is widely released, paper jam in the connection position 38 and maintenance can be facilitated.

Figure 15:
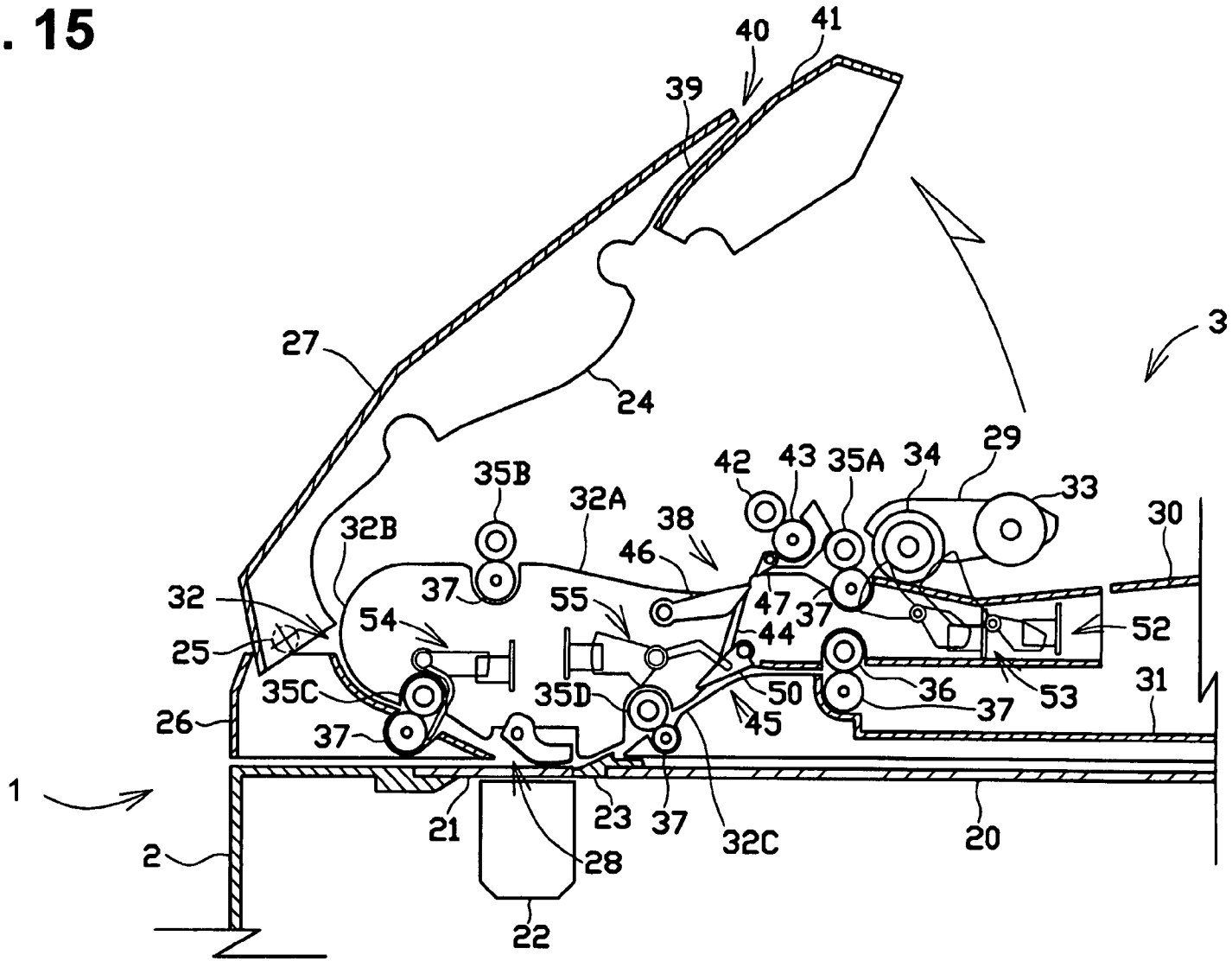
FIG. 15 is an enlarged view of an internal structure of a another image reading apparatus according to at least one illustrative aspect of the invention.
Figure 16:
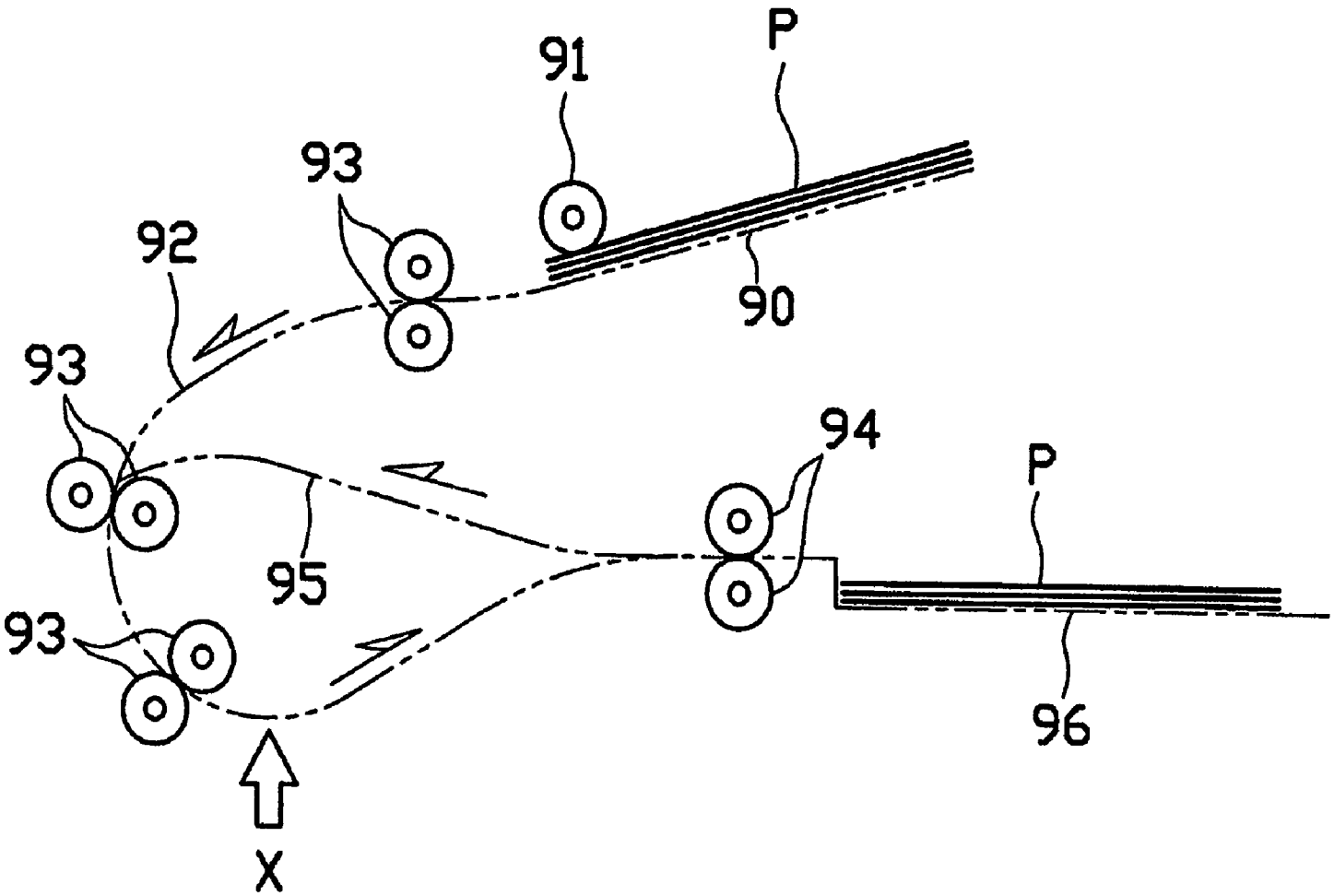
PRIOR ART Fig. 16
FIG. 16 schematically illustrates a structure of a related-art automatic document feeder according to at least one illustrative aspect of the invention.

As shown in FIG. 15, the upper guide surface of the bidirectional feed path 39 may be fixed to and rotated along with the ADF cover 27. Thus, when the ADF cover 27 is opened, the upper guide surface of the bidirectional feed path 39 is rotated along with the ADF cover 27. As a result, the document feed path 32 from a vicinity of the connection position 38 to a part of the curved portion 32B is released and the bidirectional feed path 39 is also released, so that at least a part of the document G is exposed in any case shown in FIGS. 7, 10, and 12. Thus, paper cam in the document feed path 32 and the bidirectional feed path 39 can be cleared. Especially, as the connection position 38 where the document G is fed in three directions is widely released, paper jam in the connection position 38 and maintenance can be facilitated.

As shown in FIG. 15, the arrangement of the bidirectional feed roller 42 and the pinch roller 43 may be reversed, so that the bidirectional feed roller 42 may be disposed on the upper guide surface of the bidirectional feed path 39 and the pinch roller 43 may be disposed on a lower guide surface of the bidirectional feed path 39. The bidirectional feed roller 42 and the pinch roller 43 may be supported by members forming the ADF frame 26. With this structure, the ADF cover 27 does not need an engagement mechanism to maintain its closed position against the urging force of the pinch roller 43. Thus, the ADF cover 27 can be structured simply.

What is claimed is:

1. An automatic document feeder comprising:

a cover;

an input tray configured to receive a document;

an output tray positioned below the input tray;

transfer elements for transferring the document from the input tray to the output tray;

an input transfer path configured to guide the document during transfer from the input tray, past a scanning point, to an end point positioned above the input tray; and an output transfer path configured to guide the document during transfer from the end point past the scanning point to the output tray; and an intermediate transfer path configured to guide the document during transfer from the end point, past the scanning point, to the end point again, wherein the intermediate transfer path and the input transfer path overlap to form a common path;

wherein the common path forms a loop from a connection point, included in the input transfer path between the input tray and the scanning point and in the intermediate transfer path from the end point to the scanning point, returning to the connection point included in the input transfer path and the intermediate transfer path between the scanning point and the end point, wherein a first guide member is configured to open the common path from the input tray to the scanning point, the first guide member including a pair of guide members, one of the pair of guide members configured to be separated from the other of the pair of guide members responsive to the cover being moved to an open position.

2. The automatic document feeder according to claim 1, wherein two of the transfer elements are disposed in the input transfer path, and spaced from each other a distance more than a length of the document that the automatic document feeder is capable of feeding.

3. The automatic document feeder according to claim 2, wherein the two transfer elements are disposed between the input tray and the scanning point.

4. The automatic document feeder according to claim 1, further including a second guide member, the second guide member being movable with respect to the first guide member, and the second guide member includes a part of the intermediate transfer path.

5. The automatic document feeder according to claim 1, further including a second guide member, the second guide member being movable with respect to the first guide member, and the first guide member includes one of the transfer elements.

6. The automatic document feeder according to claim 1, further including a second guide member, wherein the common path is defined between the first guide member and the second guide member and the first guide member is separable from the second guide member.

7. The automatic document feeder according to claim 1, wherein the connection point is included in the output transfer path from the end point to the scanning point.

8. An automatic document feeder comprising:

a cover;

an input tray configured to receive a document;

an output tray positioned below the input tray;

a first transfer path configured to guide the document from the input tray, past a scanning point, to the output tray, transfer elements for transferring the document from the input tray to the output tray including a bidirectional transfer element;

a second transfer path branching from a point downstream of the scanning point in the first transfer path through a connection point and past the bidirectional transfer element to an end point positioned above the input tray, wherein the first transfer path includes a loop from the connection point, past the scanning point, returning to the connection point;

a pair of guide members forming at least part of the loop, one of the pair of the guide members configured to be separated from the other of the pair of the guide members responsive to the cover being moved to an open position, wherein the bidirectional transfer element is disposed in a position closer to one of the input tray and the output tray than the connection point.

9. The automatic document feeder according claim 8, wherein an upper part of the loop, including portions of the first transfer path between the connection point and the pair of guide members and between the pair of guide members and the scanning point, is exposed when the pair of guide members is in the open position.

10. The automatic document feeder according claim 9, wherein the upper part of the loop is a substantially linear surface.

11. The automatic document feeder according claim 8, wherein a length of a bidirectional feed path is shorter than a length of the maximum sized document that is capable of undergoing double-sided scanning.

12. An automatic document feeder comprising:

a cover;

an input tray configured to receive a document;

an output tray positioned below the input tray;

transfer elements for transferring the document from the input tray to the output tray;

an input transfer path configured to guide the document during transfer from the input tray, past a scanning point, to an end point positioned above the input tray; and an output transfer path configured to guide the document during transfer from the end point through a connection point and the scanning point to the output tray; and an intermediate transfer path configured to guide the document during transfer from the end point through the connection point, the scanning point, and the connection point in that sequence, and back to the end point again, wherein the intermediate transfer path and the input transfer path include a common path;

wherein the common path forms a loop from the connection point, included in the input transfer path between the input tray and the scanning point and in the intermediate transfer path from the end point to the scanning point, returning to the connection point included in the input transfer path and the intermediate transfer path between the scanning point and the end point, wherein a first guide member is configured to open the common path from the input tray to the scanning point, the first guide member including a pair of guide members, one of the pair of guide members configured to be separated from the other of the pair of guide members responsive to the cover being moved to an open position.

* * * * *